US011117384B2

(12) United States Patent
Mizuno

(10) Patent No.: US 11,117,384 B2
(45) Date of Patent: Sep. 14, 2021

(54) LIQUID DISCHARGING HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 22 days.

(21) Appl. No.: 16/428,316

(22) Filed: May 31, 2019

(65) Prior Publication Data

US 2020/0031134 A1 Jan. 30, 2020

(30) Foreign Application Priority Data

Jul. 26, 2018 (JP) ..... JP2018-140570

(51) Int. Cl.
*B41J 2/175* (2006.01)
*B41J 2/14* (2006.01)

(52) U.S. Cl.
CPC ..... *B41J 2/17563* (2013.01); *B41J 2/1433* (2013.01); *B41J 2002/14419* (2013.01)

(58) Field of Classification Search
CPC .... B41J 2002/14419; B41J 2002/14306; B41J 2002/14459; B41J 2002/14362; B41J 2202/20; B41J 2202/07; B41J 2202/12; B41J 2/17563; B41J 2/01
See application file for complete search history.

(56) References Cited

U.S. PATENT DOCUMENTS 8,733,908 B2 * 5/2014 Borra ..... B41J 2/18 347/85
2005/0157104 A1 * 7/2005 Hirota ..... B41J 2/17513 347/85
2006/0227174 A1 10/2006 Taira
2007/0229602 A1 10/2007 Taira et al.
2009/0102879 A1 * 4/2009 Katada ..... B41J 2/17513 347/17
2010/0238238 A1 * 9/2010 Yamamoto ..... B41J 2/1404 347/85
2011/0025760 A1 * 2/2011 Rosati ..... B41J 2/16547 347/34

(Continued)

FOREIGN PATENT DOCUMENTS

JP 2006-297897 A 11/2006
JP 2007-268868 A 10/2007
JP 2013-067111 A 4/2013

*Primary Examiner* — John Zimmermann
(74) *Attorney, Agent, or Firm* — Baker Botts L.L.P.

(57) ABSTRACT

A liquid discharging head includes: individual channels each including a nozzle; an inflow channel communicated with the individual channels; an outflow channel communicated with the individual channels; an inflow-side filter provided on the inflow channel and dividing the inflow channel into a lower inflow area and an upper inflow area; an outflow-side filter provided on the outflow channel and dividing the outflow channel into a lower outflow area and an upper outflow area; an inflow port which is provided on the upper inflow area and through which the liquid is supplied to the inflow channel from outside thereof; an outflow port which is provided on the upper outflow area and through which the liquid is discharged from the outflow channel to outside thereof; and a bypass channel connecting the upper inflow area and the upper outflow area.

22 Claims, 11 Drawing Sheets

(56) References Cited

U.S. PATENT DOCUMENTS

| | | | | |
|---|---|---|---|---|
| 2012/0026262 | A1* | 2/2012 | Shimizu | B41J 2/175<br>347/93 |
| 2017/0197413 | A1* | 7/2017 | Nakagawa | B41J 2/14145 |
| 2018/0154649 | A1* | 6/2018 | Ueda | B41J 2/185 |
| 2019/0030904 | A1* | 1/2019 | Katakura | B41J 2/175 |

* cited by examiner

LIQUID DISCHARGING HEAD

CROSS REFERENCE TO RELATED APPLICATION

The present application claims priority from Japanese Patent Application No. 2018-140570, filed on Jul. 26, 2018, the disclosure of which is incorporated herein by reference in its entirety.

BACKGROUND

Field of the Invention

The present disclosure relates to a liquid discharging head which discharge (jets) a liquid from a nozzle.

Description of the Related Art

As a liquid discharging head which discharges a liquid from nozzles, there is known an ink-jet head which discharges an ink from nozzles. In this ink jet head, an inflow port, a discharge port (exhaust port), a main channel, a discharge channel and an outflow channel are formed in a channel member constructing a reservoir unit. The main channel is partitioned or divided into an upper part and a lower part by a filter, and the ink supplied from the inflow port to the main channel flows into the lower part, of the main channel, which is located below or on the lower side of the filter. The discharge channel is connected to the lower part, of the main channel, which is located below the filter. The discharge port is connected to an end part, of the discharge channel, which is on the opposite side to the main channel. The outflow channel is connected to the upper part, of the main channel, which is located above or on the upper side of the filter. Further, the outflow channel is communicated with an ink channel in a main body of the liquid discharging head via a distributing channel, a supply channel, etc., which are formed in a plate constructing the reservoir unit.

With this configuration, in the reservoir unit, the ink inflowed from the inflow port into the lower part, of the main channel, located below the filter passes through the filter, whereby any air bubbles, etc., in the ink are removed therefrom; and then the ink inflows into the upper part, of the main channel, above the filter and further inflows into the outflow channel. Then, the ink is supplied from the outflow channel to the main body of the head, via the distributing channel, the supply channel, etc. Furthermore, the ink in the lower part, of the main channel, below the filter is discharged from the discharge port via the discharge channel. With this, the ink in the lower part, of the main channel, below the filer and in the inside of the discharge channel is circulated.

SUMMARY

Here, in the above-described ink-jet head, the ink inside the main flow channel flows from the lower side to the upper side so as to pass through the filter. Further, in the above-described ink-jet head, the main channel and the discharge channel are connected with each other at the lower part, of the main channel, below the filter. Since the air bubbles in the ink tend to float upward, in the above-described configuration, the air bubbles in the ink at the lower part, of the main channel, below the filter are less likely to be discharged from the discharge channel; such air bubbles are rather likely to pass through the filter and to flow to the side of the nozzles.

An object of the present disclosure is to provide a liquid discharging head capable of discharging (exhausting) air bubbles inside a flow channel (channel) in an assured manner.

According to an aspect of the present disclosure, there is provided a liquid discharging head including: individual channels each of which includes a nozzle; an inflow channel which is communicated with the individual channels and via which liquid flows into the individual channels; an outflow channel which is communicated with the individual channels and via which the liquid flows out from the individual channels; an inflow-side filter which is provided on the inflow channel and which divides the inflow channel into a lower inflow area communicated with the individual channels and an upper inflow area located above the lower inflow area; an outflow-side filter which is provided on the outflow channel and which divides the outflow channel into a lower outflow area communicated with the individual channels and an upper outflow area located above the lower outflow area; an inflow port which is provided on the upper inflow area and through which the liquid is supplied to the inflow channel from outside thereof; an outflow port which is provided on the upper outflow area and through which the liquid is discharged from the outflow channel to outside thereof and a bypass channel which connects the upper inflow area and the upper outflow area.

EMBODIMENT

An embodiment of the present disclosure will be explained as follows.

Figure 1:
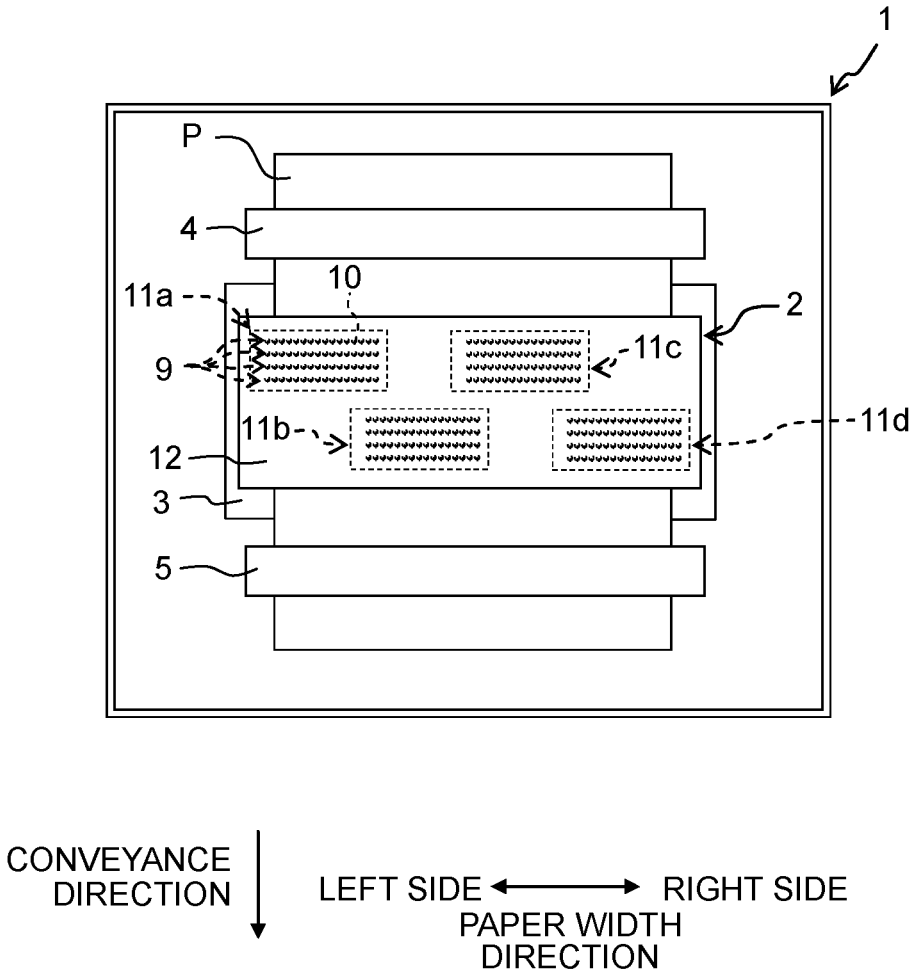
FIG. 1 is a view depicting the overall configuration of a printer according to an embodiment of the present disclosure.

As depicted in FIG. 1, a printer 1 according to the present embodiment is provided with an ink-jet head 2, a platen 3 and conveyance rollers 4 and 5.

The ink-jet head 2 has four head units 11*a* to 11*d* (corresponding to a "liquid discharging head" of the present disclosure), and a holding member 12. Each of the head units 11*a* to 11*d* discharges an ink from a plurality of nozzles 10 formed in a lower surface thereof. To provide a more specific explanation, the plurality of nozzles 10 are aligned in a paper width direction (corresponding to a "first direction" of the present disclosure) which is horizontal and is a left-right direction in FIG. 1 to thereby form a nozzle array 9 (nozzle row 9); each of the head units 11*a* to 11*d* has four nozzle arrays 9 which are arranged side by side in a conveyance direction (corresponding to a "second direction" of the present disclosure) which is horizontal and is orthogonal to the paper width direction. Further, in an order from an upstream-most nozzle array 9 included in the four nozzle arrays 9 and located on the upstream side in the conveyance direction toward other nozzle arrays 9 located downstream relative to the upstream-most nozzle array 9 in the conveyance direction, inks of black, yellow, cyan and magenta colors are discharged from the plurality of nozzles 10 of the four nozzle arrays 9, respectively. Note that in the following explanation, the right side and the left side of the paper width direction are defined as those depicted in FIG. 1.

Among the four head units 11*a* to 11*d*, the head unit 11*a* and the head unit 11*c* are disposed respectively at positions which are same in the conveyance direction, and are arranged side by side in the paper width direction with a spacing distance therebetween. Further, the head unit 11*b* and the head unit 11*d* are disposed respectively at positions which are same in the conveyance direction and on the downstream side in the conveyance direction with respect to the head units 11*a* and 11*c*, and are arranged side by side in the paper width direction with a spacing distance therebetween.

Furthermore, the head units 11*a* and 11*c* and the head units 11*b* and 11*d* are arranged to shifted to each other in the paper width direction; a right end part of the head unit 11*a* and a left end part of the head unit 11*b* overlap with each other in the conveyance direction, a right end part of the head unit 11*b* and a left end part of the head unit 11*c* overlap with each other in the conveyance direction, and a right end part of the head unit 11*c* and a left end part of the head unit 11*d* overlap with each other in the conveyance direction.

With this, in the ink-jet head 2, the plurality of nozzles 10, respectively, of the four head units 11*a* to 11*d* are arranged over the entire length in the paper width direction of a recording paper sheet (recording paper) P. Namely, the ink jet head 2 is a so-called line head. The holding member 12 is a plate-shaped member extending in the paper width direction and the conveyance direction, and holds the four head units 11*a* to 11*d* in the above-described positional relationship.

The platen 3 is located below or under the ink-jet head 2, and faces (is opposite to) the four head units 11*a* to 11*d*. The platen 3 supports the recording paper sheet P from therebelow.

The conveyance roller 4 is located on the upstream side in the conveyance direction relative to the ink-jet head 2. The conveyance roller 5 is located on the downstream side in the conveyance direction relative to the ink-jet head 2. The conveyance rollers 4 and 5 convey the paper sheet P in the conveyance direction.

Further, the printer 1 performs recording on the recording paper P by causing the ink(s) to be discharged from the plurality of nozzles 10 of the ink-jet head 2 (head units 11*a* to 11*d*) while conveying the paper sheet P in the conveyance direction with the conveyance rollers 4 and 5.

<Head Unit 11>

Next, the head units 11*a* to 11*d* are explained in detail. Note, however, that since the head units 11*a* to 11*d* have the same configuration, the following explanation will be given about one of the head units 11*a* to 11*d*. Further, in the following explanation, in a case that the head units 11*a* to 11*d* are not discriminated, the head units 11*a* to 11*d* are described (collectively) as the "head unit 11".

As depicted in FIGS. 2 to 9, the head unit 11 is provided with a head chip 21, a manifold plate 22, an inlet plate 23, a filter unit 24 and a joint member 25.

<Head Chip 21>

As depicted in FIGS. 3A, 4, 5 and 6, the head chip 21 is provided with a pressure chamber substrate 31, a nozzle plate 32, a vibration film 33, four piezoelectric actuators 34 and a channel substrate 35. The pressure chamber substrate 31 is formed, for example, of silicon (Si; a "first material" of the present disclosure). The pressure chamber substrate 31 is formed with a plurality of pressure chambers 40. Each of the pressure chambers 40 extends in the conveyance direction. The plurality of pressure chambers 40 are aligned in the paper width direction to thereby form a pressure chamber array 39; four pressure chamber arrays 39 are arranged side by side in the pressure chamber substrate 31.

The nozzle plate 32 is formed, for example, of a synthetic resin material such as polyimide, etc. The plurality of nozzles 10 are formed in the nozzle plate 32. Each of the plurality of nozzles 10 is formed in a part, of the nozzle plate 32, which overlap with a central part in the paper width direction and of the conveyance direction of one of the plurality of pressure chambers 40. With this, the plurality of nozzles 10 form the four nozzle arrays 9 as described above.

The vibration film 33 is formed, for example, of silicon dioxide ($SiO_2$). The vibration film 33 is formed by oxidizing the upper surface of the pressure chamber substrate 31, and covers the plurality of pressure chambers 40. Further, the vibration film 33 is formed with inflow holes 33*a* via each of which the ink is allowed to inflow into one of the pressure chambers 40. Regarding the pressure chambers 40 constructing the first and third pressure chamber arrays 39 from the upstream side in the conveyance direction, each of the inflow holes 33*a* is formed at a part, of the vibration film 33, overlapping in the up-down direction with an end part on the upstream side in the conveyance direction of one of the pressure chambers 40; regarding the pressure chambers 40 constructing the second and fourth pressure chamber arrays 39 from the upstream side in the conveyance direction, each of the inflow holes 33*a* is formed at a part, of the vibration film 33, overlapping in the up-down direction with an end part on the downstream side in the conveyance direction of one of the pressure chambers 40. Furthermore, the vibration film 33 is formed with outflow holes 33*b* via each of which the ink is allowed to outflow from one of the pressure chambers 40. Regarding the pressure chambers 40 constructing the first and third pressure chamber arrays 39 from the upstream side in the conveyance direction, each of the outflow holes 33*b* is formed at a part, of the vibration film 33, overlapping in the up-down direction with an end part on the downstream side in the conveyance direction of one of the pressure chambers 40; regarding the pressure chambers 40 constructing the second and fourth pressure chamber arrays 39 from the upstream side in the conveyance direction, each of the outflow holes 33*b* is formed at a part, of the vibration film 33, overlapping in the up-down direction with an end part on the upstream side in the conveyance direction of one of the pressure chambers 40.

The four piezoelectric actuators 34 correspond to the four pressure chamber arrays 39, respectively. Each of the piezoelectric actuators 34 is provided with a piezoelectric layer 41, a lower electrode 42, a plurality of upper electrodes 43, etc. The piezoelectric layer 41 is formed of a piezoelectric material containing lead zirconate titanate as a main component thereof, and is arranged on the upper surface of the vibration film 33; the piezoelectric layer 41 extends in the paper width direction spanning across the plurality of pressure chambers 40 constructing each of the plurality of pressure chamber arrays 39. The lower electrode 42 is arranged between the vibration film 33 and the piezoelectric layer 41, and extends in the paper width direction spanning across the plurality of pressure chambers 40 constructing each of the plurality of pressure chamber arrays 39. The lower electrode 42 is maintained at the ground potential. The plurality of upper electrodes 43 are provided independently for the plurality of pressure chambers 40, respectively. Each of the plurality of upper electrodes 43 has a planer shape which is substantially rectangular and of which longitudinal direction is the conveyance direction. Each of the upper electrodes 43 is arranged on the upper surface of the piezoelectric layer 41 so as to overlap, in the up-down direction, with the central part of one of the plurality of pressure chamber 40. Either one of the ground potential and a predetermined driving potential (for example, about 20V) is selectively applied to each of the upper electrodes 43 by a non-illustrated driver IC.

Note that in addition to the above-described configuration, the piezoelectric actuator 34 is provided with an insulator film configured to secure the insulation between the electrodes, a protective film configured to protect the piezoelectric layer 41 and the electrodes 42 and 43, etc. However, since the configuration of the piezoelectric actuator 34 itself is same as a conventional piezoelectric actuator, any specific explanation therefor is omitted here. Further, contrary to the above-described configuration, the piezoelectric actuator 34 may be configured such that individual electrodes, which are provided individually for the plurality of pressure chambers 40, respectively, are arranged between the vibration film 33 and the piezoelectric layer 41 and that a common electrode which is common to the plurality of pressure chambers 40 is arranged on the upper surface of the piezoelectric layer 41. Furthermore, it is allowable to provide individual piezoelectric bodies with respect to the plurality of pressure chambers 40, respectively, rather than providing the piezoelectric layer 41 extending over the plurality of pressure chambers 40 constructing each of the pressure chamber arrays 39.

Here, a method of discharging (jetting) the ink(s) from the nozzles 10 by driving the piezoelectric actuator 43 will be explained. In the piezoelectric actuators 34, the plurality of upper electrodes 43 are maintained at the ground potential which is same as the potential of the lower electrode 42. In order to cause the ink to be discharged from a certain nozzle 10, included in the plurality of nozzles 10, the potential of a certain upper electrode 43 included in the plurality of upper electrodes 43 and corresponding to the certain nozzle 10 is switched from the ground potential to the driving potential. Then, the potential difference between the upper and the lower electrodes 42 and 43 generates an electric field in a thickness direction of the thickness of the piezoelectric layer 41; this electric field causes the piezoelectric layer 41 to contract in the horizontal direction orthogonal to the thickness direction, thereby deforming parts of the vibration film 33 and the piezoelectric layer 41, respectively, overlapping in the up-down direction with a certain pressure chamber 40 included in the plurality of pressure chambers 40 and corresponding to the certain nozzle 10 to project toward the certain pressure chamber 40, which in turn reduces the volume of the certain pressure chamber 40. As a result, the pressure of the ink inside the certain pressure chamber 40 is increased, thereby causing the ink to be discharged from the certain nozzle 10 communicating with the certain pressure chamber 40.

The channel substrate 35 is formed of silicon (Si) and is arranged on the upper surface of the vibration film 33. The channel substrate 35 is formed with inflow throttle channels 35*a* extending in the up-down direction at parts thereof each of which overlaps, in the up-down direction, with one of the inflow holes 33*a*. Further, the channel substrate 35 is formed with outflow throttle channels 35*b* extending in the up-down direction at parts thereof each of which overlaps, in the up-down direction, with one of the outflow holes 33*b*. Furthermore, four recessed parts 35*c* corresponding to the four piezoelectric actuators 34, respectively, are formed at a lower end part of the channel substrate 35. Moreover, each of the piezoelectric actuators 34 is arranged inside a space defined by the vibration film 33 and one of the recessed parts 35*c*.

Further, in the head chip 21, an individual channel 38 is formed of a nozzle 10, a pressure chamber 40 connected to the nozzle 10, an inflow throttle channel 35*a* connected to the pressure chamber 40 via the inflow hole 33*a*, and an outflow throttle channel 35*b* connected to the pressure chamber 40 via the outflow hole 33*b*. Furthermore, such an individual channel 38 is formed as a plurality of individual channels 38 in the head chip 21.

<Manifold Plate 22>

Figure 3A:
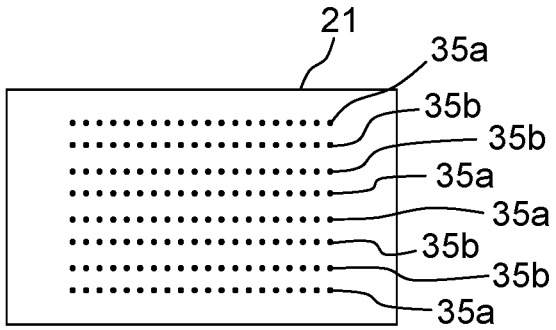
FIG. 3A is a plan view of a head chip.
Figure 3B:
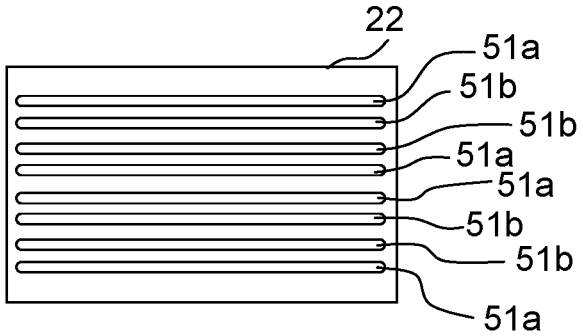
FIG. 3B is a plan view of a manifold plate.
Figure 6:
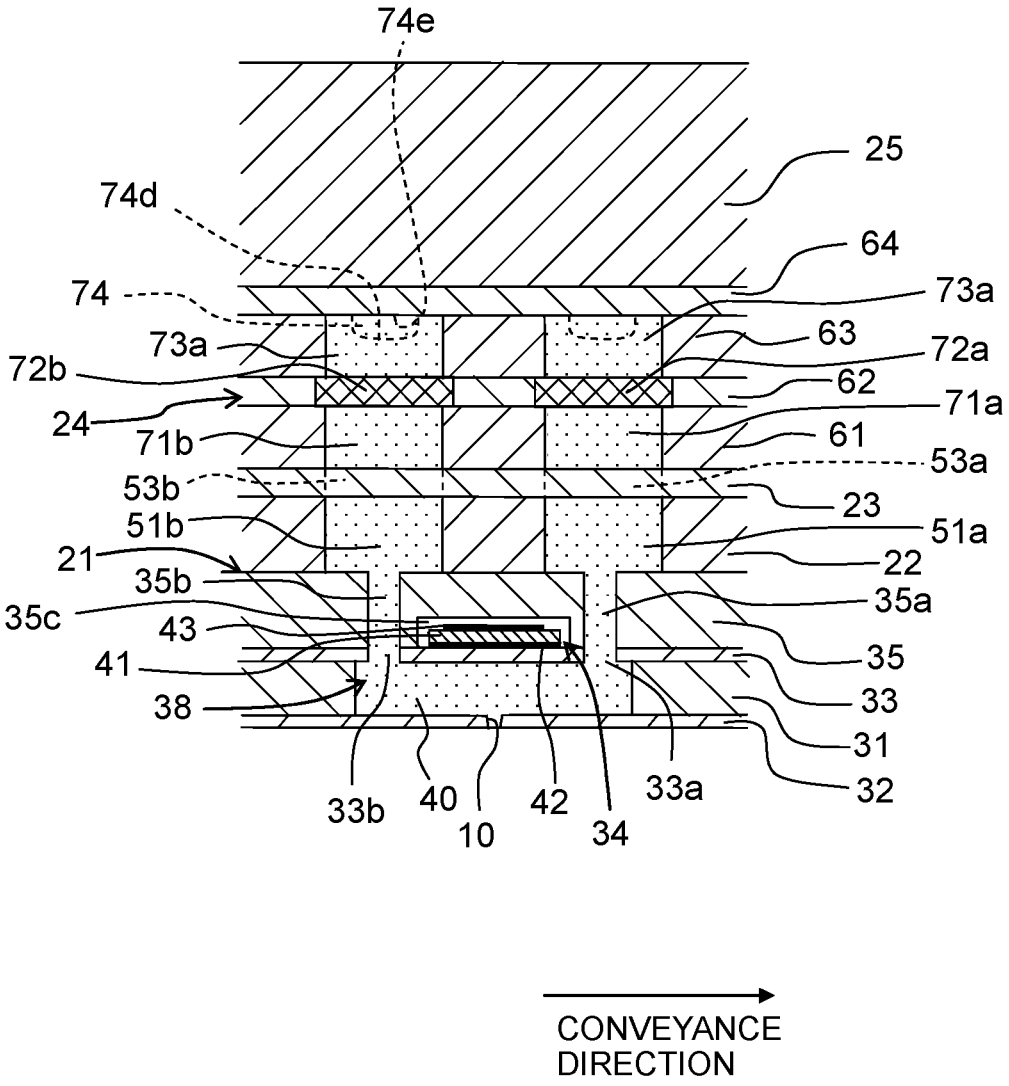
FIG. 6 is a cross-sectional view taken along a line VI-VI in FIG. 5.

As depicted in FIGS. 3B and 6, the manifold plate 22 is formed of 42 Alloy (a "second material" of the present disclosure) and is arranged on the upper surface of the channel substrate 35. The manifold plate 22 is formed with four inflow manifolds 51*a* and four outflow manifolds 51*b*. The four inflow manifolds 51*a* correspond to the four pressure chamber arrays 39, respectively. Each of the inflow manifolds 51*a* extends in the paper width direction, and overlaps in the up-down direction with the plurality of inflow throttle channels 35*a* communicating with the plurality of pressure chambers 40 constructing one of the pressure chamber arrays 39 corresponding to each of the inflow manifolds 51*a*.

The four outflow manifolds 51*b* correspond to the four pressure chamber arrays 39, respectively. Each of the outflow manifolds 51*b* extends in the paper width direction, and overlaps in the up-down direction with the plurality of outflow throttle channels 35*b* communicating with the plurality of pressure chambers 40 constructing one of the pressure chamber arrays 39 corresponding to each of the outflow manifolds 51*b*.

<Inlet Plate 23>

Figure 2:
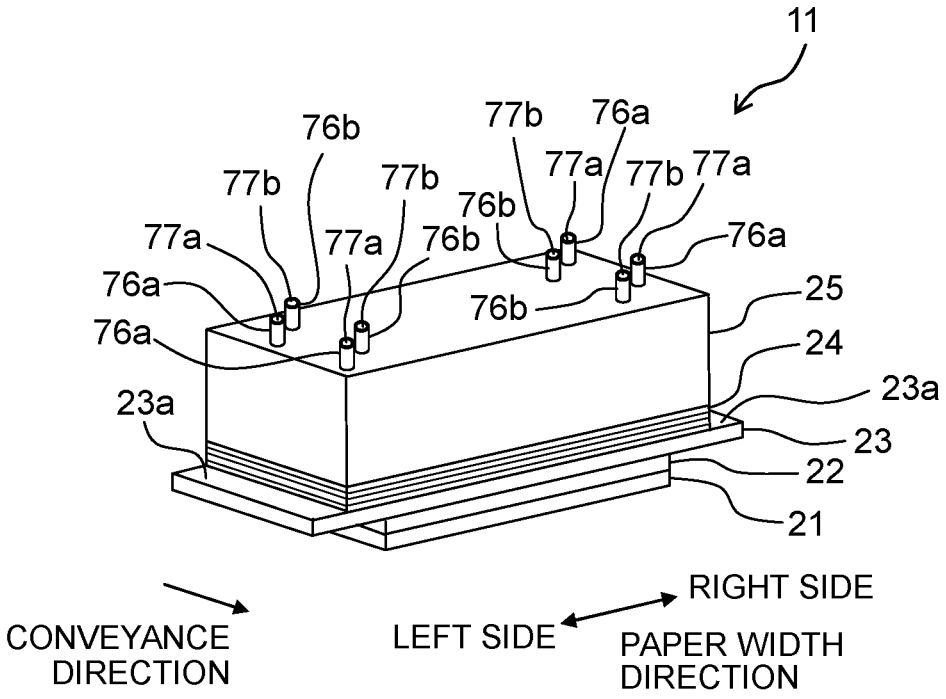
FIG. 2 is a perspective view depicting the overall configuration of a head unit of FIG. 1.
Figure 3C:
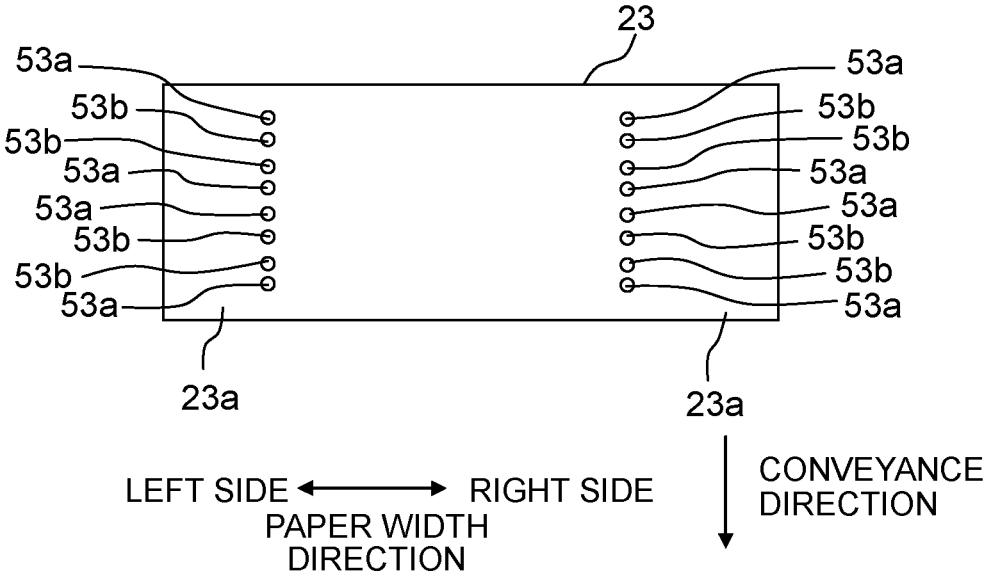
FIG. 3C is a plan view of an inlet plate.
Figure 4:
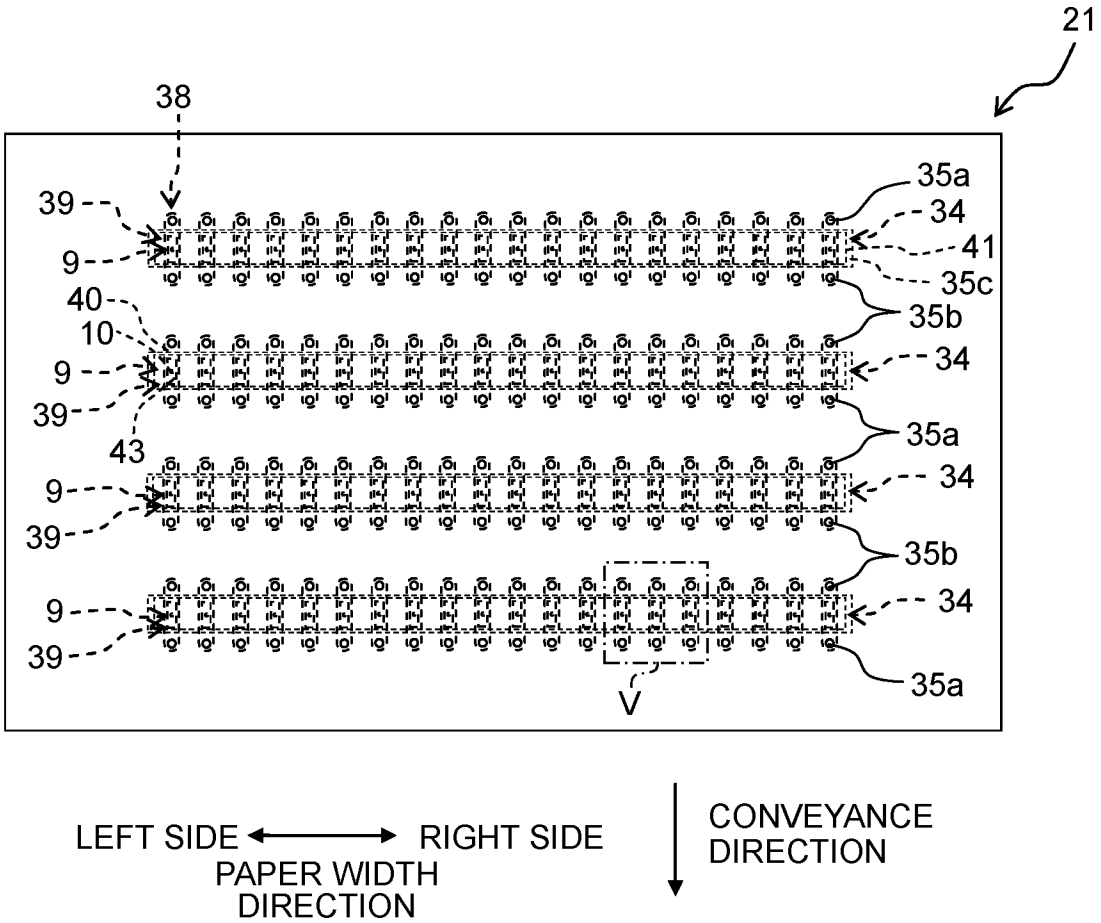
FIG. 4 is an enlarged view of the head chip, depicting internal channels, etc., therein with broken lines.
Figure 5:
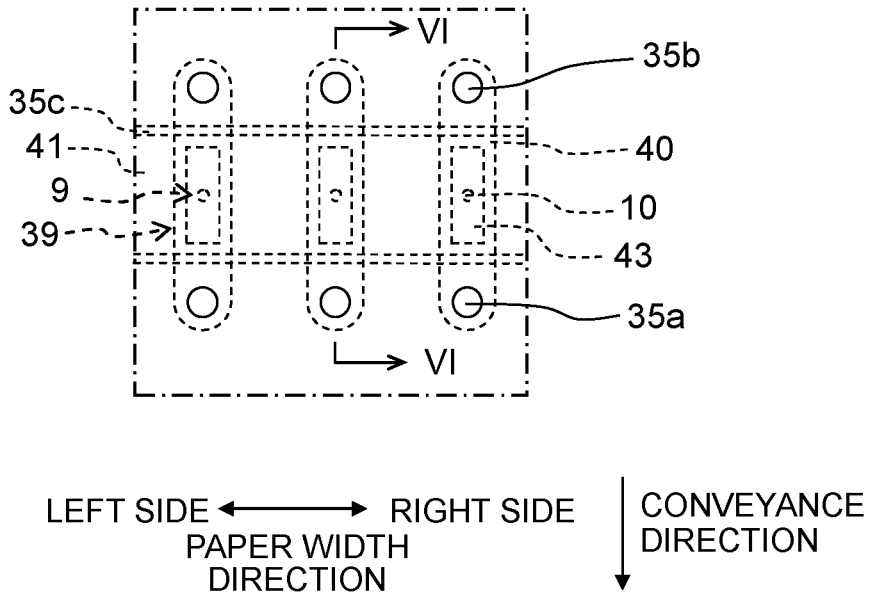
FIG. 5 is an enlarged view of a part "V" in FIG. 4.

As depicted in FIGS. 3C and 6, the inlet plate 23 is formed of 42 Alloy and is arranged on the upper surface of the manifold plate 22. Inflow holes 53*a* are formed in the inlet plate 23 at parts thereof each of which overlaps, in the up-down direction, with both end parts in the paper width direction of one of the inflow manifolds 51*a*. Further, outflow holes 53*a* are formed in the inlet plate 23 at parts thereof each of which overlaps, in the up-down direction, with both end parts in the paper width direction of one of the outflow manifolds 51*b*. Furthermore, the inlet plate 23 extends toward the both sides in the paper width direction outwardly relative to (beyond) the head chip 21, the manifold plate 23, the filter unit 24 and the joint member 25 (see FIG. 2). Moreover, both end parts in the paper width direction of the inlet plate 23 are fixed parts 23*a* which are fixed to the holding member 12.

<Filter Unit 24>

As depicted in FIGS. 6 to 9, the filter unit 24 is formed by stacking, in the up-down direction, four plates 61 and 64 formed of 42 Alloy.

As depicted in FIGS. 6, 7A, 9A and 9B, the plate 61 is arranged on the upper surface of the inlet plate 23. The plate 61 is formed with four lower inflow channels 71*a* (corresponding to an "lower inflow area" of the present disclosure) and four lower outflow channels 71*b* (corresponding to an "lower outflow area" of the present disclosure).

The four lower inflow channels 71*a* correspond to the four inflow manifolds 51*a*, respectively. Each of the lower inflow channels 71*a* extends in the paper width direction, and substantially entirety thereof overlaps, in the up-down direction, one of the inflow manifolds 51*a* corresponding thereto. Further, an inflow manifolds 51*a* included in the four inflow manifolds 51*a* and an lower inflow channel 71*a* included in the four lower inflow channels 71*a* which correspond to each other are communicated to each other via the inflow holes 53*a* corresponding to the inflow manifold 51*a*.

The four lower outflow channels 71*b* correspond to the four outflow manifolds 51*b*, respectively. Each of the lower outflow channels 71*b* extends in the paper width direction, and substantially entirety thereof overlaps, in the up-down direction, one of the outflow manifolds 51*b* corresponding thereto. Further, an outflow manifolds 51*b* included in the four outflow manifolds 51*b* and an lower outflow channel 71*b* included in the four lower outflow channels 71*b* which correspond to each other are communicated to each other via the outflow holes 53*b* corresponding to the outflow manifold 51*b*.

As depicted in FIGS. 6, 7B, 9A and 9B, the plate 62 is arranged on the upper surface of the plate 61. Four inflow-side filters 72*a* are formed in the plate 62 at parts thereof which overlap, in the up-down direction, with the four lower inflow channels 71*a*, respectively. Further, four outflow-side filters 72*b* are formed in the plate 62 at parts thereof which overlap, in the up-down direction, with the four lower outflow channels 71*b*, respectively.

As depicted in FIGS. 6, 7C, 8, 9A and 9B, the plate 63 is arranged on the upper surface of the plate 62. The plate 63 is formed with four upper inflow channels 73*a* (corresponding to an "upper inflow area" of the present disclosure), four upper outflow channels 73*b* (corresponding to an "upper outflow area" of the present disclosure), and four bypass channels 74.

The four upper inflow channels 73*a* correspond to the four lower inflow channels 71*a*, respectively. Each of the upper inflow channels 73*a* penetrates through the plate 63, extends in the paper width direction and overlaps, in the up-down direction, with one of the lower inflow channels 71*a* corresponding thereto. With this, an lower inflow channels 71*a* included in the four lower inflow channels 71*a* and an upper inflow channel 73*a* included in the four upper inflow channels 73*a* which correspond to each other are communicated to each other via one of the four inflow-side filters 72*a* overlapping with (corresponding to) the lower inflow channel 71*a*. Here, in the present embodiment, length in the paper width direction of the nozzle array 9 is, for example, about 33 mm, whereas length in the paper width direction of each of the upper inflow channel 73*a* and the lower inflow channel 71*a* is, for example, about 35 mm which is greater than the length in the paper width direction of the nozzle array 9. With this, the upper inflow channel 73*a* and the lower inflow channel 71*a* overlap with each other in the up-down direction, over an area not less than the length in the paper width direction of the nozzle array 9.

The four upper outflow channels 73*b* correspond to the four lower outflow channels 71*b*, respectively. Each of the upper outflow channels 73*b* penetrates through the plate 63, extends in the paper width direction and overlaps, in the up-down direction, with one of the lower outflow channels 71*b* corresponding thereto. With this, an lower outflow channels 71*b* included in the four lower outflow channels 71*b* and an upper outflow channel 73*b* included in the four upper outflow channels 73*b* which correspond to each other are communicated to each other via one of the four outflow-side filters 71*b* overlapping with (corresponding to) the lower outflow channel 71*b*. Here, in the present embodiment, the length in the paper width direction of the nozzle array 9 is, for example, about 33 mm, whereas length in the paper width direction of each of the upper outflow channel 73*b* and the lower outflow channel 71*b* is, for example, about 35 mm which is greater than the length in the paper width direction of the nozzle array 9. With this, the upper outflow channel 73*b* and the lower outflow channel 71*b* overlap with each other in the up-down direction, over an area not less than the length in the paper width direction of the nozzle array 9.

Further, each of the upper inflow channels 73*a* has side wall surfaces 73*a*1, on the both end parts in the paper width direction of the upper inflow channel 73*a*, which are arc-shaped curved surfaces, respectively. Namely, each of the side wall surfaces 73*a* 1 is inclined with respect to the paper width direction such that each of the side wall surfaces 73*a* 1 is located further on the inner side with respect to the conveyance direction, progressively in a direction toward the end in the paper width direction of each of the upper inflow channel 73*a*. Further, each of the upper outflow channels 73*b* have side wall surfaces 73*b*1, on the both end parts in the paper width direction of the upper outflow channel 73*b*, which are arc-shaped curved surfaces, respectively. Namely, each of the side wall surfaces 73*b*1 is inclined with respect to the paper width direction such that each of the side wall surfaces 73*b*1 is located further on the inner side with respect to the conveyance direction, progressively in a direction toward the end in the paper width direction of each of the upper outflow channel 73*b*.

The upper inflow channel 73*a* and the upper outflow channel 73*b* have lengths in the paper width direction which are substantially same. Further, an upper inflow channel 73*a* included in the four upper inflow channels 73*a* and an upper outflow channel 73*b* included in the four upper outflow channels 73*b* which correspond to a same pressure chamber arrays 39 included in the four pressure chamber arrays 39 are arranged to shift from each other in the paper width direction. To provide more detailed explanation, an upper inflow channel 73*a* and an upper outflow channel 73*b* corresponding to each of the first and third pressure chamber arrays 39 from the upstream side in the conveyance direction, the upper inflow channel 73*a* is located on the right side in the paper width direction with respect to the upper outflow channel 73*b*. On the other hand, an upper inflow channel 73*a* and an upper outflow channel 73*b* corresponding to each of the second and fourth pressure chamber arrays 39 from the upstream side in the conveyance direction, the upper inflow channel 73*a* is located on the left side in the paper width direction with respect to the upper outflow channel 73*b*.

Note that in the present embodiment, a channel obtained by combining each of the lower inflow channels 71*a* and one of the upper inflow channels 73*a* corresponding thereto corresponds to an "inflow channel" of the present disclosure. Further, this inflow channel is divided (partitioned) into the lower inflow channel 71*a* and the upper inflow channel 73*a* by the inflow-side filter 72*a*. Further, a channel obtained by combining each of the lower outflow channels 71*b* and one of the upper outflow channels 73*b* corresponding thereto corresponds to an "outflow channel" of the present disclosure. Further, this outflow channel is divided (partitioned) into the lower outflow channel 71*b* and the upper outflow channel 73*b* by the outflow-side filter 72*b*.

Each of the four bypass channels 74 is a channel connecting an upper inflow channel 73*a* included in the four upper inflow channels 73*a* and an upper outflow channel 73*b* included in the four upper outflow channels 73*b* which correspond to a same pressure chamber arrays 39 included in the four pressure chamber arrays 39. Each of the bypass channels 74 is formed at an upper part of the plate 63, and does not penetrate through the plate 63. Accordingly, the depth (length in the up-down direction) of each of the bypass channels 74 is smaller than the depth of each of the upper inflow channel 73*a* and the upper outflow channels 73*b* penetrating through the plate 63. Further, the width (length in a direction orthogonal to the up-down direction and the length direction of each of the bypass channels 74) of each of the bypass channels 74 is narrower than the width (length in the conveyance direction) of each of the upper inflow channel 73*a* and the upper outflow channel 73*b*.

In view of the above-described configuration, the cross section, of each of the bypass channels 74, which is orthogonal to the length direction of the bypass channel 74 is smaller than the cross section, of each of the upper inflow channel 73*a* and the upper outflow channel 73*b*, which is orthogonal to the length direction of each of the upper inflow channel 73*a* and the upper outflow channel 73*b*. For example, the cross section, of each of the upper inflow channel 73*a* and the upper outflow channel 73*b*, which is orthogonal to the length direction thereof is about 0.55 $mm^2$ (width 1.1 [mm]× depth 0.5 [mm]), whereas the cross section, of each of the bypass channels 74, which is orthogonal to the length direction thereof is about 0.15 $mm^2$ (width 0.5 [mm]×depth 0.3 [mm]).

In this situation, the above-described cross section of each of the upper inflow channel 73*a* and the upper outflow channel 73*b* may be a cross section to such an extent due to which any under-refilling does not occur (for example, not less than 0.3 $mm^2$), and due to which the width and/or height of the head chip does not become excessively large (for example, not more than 1 $mm^2$). On the other hand, in a case of forming the upper inflow channels 73*a* and the bypass channels 74 in a plate 63 having a thickness "t" by performing etching for the plate 63 from the both surfaces thereof, it is allowable to form the bypass channels 74 each of which has a width of about "t" and a depth of about 0.6 t on the upper part of the plate 63 by performing half-etching on the upper part. For example, in a case that the thickness of the plate 63 is about 0.5 mm, it is allowable to form the bypass channels 74 each of which has a width of about 0.5 mm (=t) and a depth of about 0.3 mm (=0.6 t). Further, the cross section of the bypass channel 74 may be made such a cross section with which the air can be discharged (exhausted) (for example, not less than 0.1 $mm^2$) and which allows the ink in the inside of the upper inflow channel 73*a* to more easily flow toward the side of the lower inflow channel 73*b*, rather than toward the side of the bypass channel 74 (for example, not more than 0.5 $mm^2$).

The length of each of the bypass channels 74 (total or sum of lengths of a first linear part 74*a*, a second linear part 74*b* and a turning part (folded part) 74*c* which are to be described below) is, for example, about 8.5 mm. Furthermore, the bypass channels 74 are formed in the upper part of the plate 63, thereby allowing each of the bypass channels 74 to connect an upper end part of the upper inflow channel 73*a* and an upper end part of the upper outflow channel 73*b*.

Each of the bypass channels 74 has a first linear part 74*a*, a second linear part 74*b* and a turning part 74*c*. The first linear part 74*a* corresponding to each of the first and third pressure chamber arrays 39 from the upstream side in the conveyance direction is connected, at a connection part thereof, to the left end in the paper width direction of the upper inflow channel 73*a*, and extends toward the left side in the paper width direction from the connection part thereof with respect to the upper inflow channel 73*a*. The first linear part 74*a* corresponding to each of the second and fourth pressure chamber arrays 39 from the upstream side in the conveyance direction is connected to the right end in the paper width direction of the upper inflow channel 73*a*, at a connection part thereof, and extends toward the right side in the paper width direction from the connection part thereof with respect to the upper inflow channel 73*a*.

The second linear part 74*b* corresponding to each of the first and third pressure chamber arrays 39 from the upstream side in the conveyance direction is connected, at a connection part thereof, to the left end in the paper width direction of the upper outflow channel 73*b*, and extends toward the left side in the paper width direction from the connection part thereof with respect to the upper outflow channel 73*b*. The second linear part 74*b* corresponding to each of the second and fourth pressure chamber arrays 39 from the upstream side in the conveyance direction is connected, at a connection part thereof, to the right end in the paper width direction of the upper outflow channel 73*b*, and extends toward the right side in the paper width direction from the connection part thereof with respect to the upper outflow channel 73*b*.

As described above, the upper inflow channel 73*a* and the upper outflow channel 73*b* are shifted from each other in the paper width direction, whereas an end of the first linear part 74*a* on a side, in the paper width direction, which is opposite to the upper inflow channel 73*a*, and an end of the second linear part 74*b* on a side, in the paper width direction, which is opposite to the upper outflow channel 73*b* are located at substantially same positions, respectively, in the paper width direction. With this, a length L2 in the paper width direction of the second linear part 74*b* is made to be shorter than a length L1 in the paper width direction of the first linear part 74*a*.

The turning part 74*c* connects the end of the first linear part 74*a* on the side, in the paper width direction, which is opposite to the upper inflow channel 73*a* to the end of the second linear part 74*b* on the side, in the paper width direction, which is opposite to the upper outflow channel 73*b* with each other. Further, side wall surfaces 74*c*1 and 74*c*2 of the turning part 74*c* are arc-shaped curved surfaces, respectively. Furthermore, the side wall surface 74*c*1, a side wall surface 74*a*1 of the first linear part 74*a* on the side opposite to the second linear part 74*b*, and a side wall surface 74*b*1 of the second linear part 74*b* on the side opposite to the first linear part 74*a* are smoothly continued (connected) to one another. Further, the side wall surface 74*c*2, a side wall surface 74*a*2 of the first linear part 74*a* on the side of the second linear part 74*b*, and a side wall surface 74*b*2 of the second linear part 74*b* on the side of the first linear part 74*a* are smoothly continued (connected) to one another.

Here, the bypass channels 74 formed in the upper part of the plate 63 are formed by performing the half-etching for the upper surface of the plate 63. Further, since the bypass channels 74 are formed by the half-etching, a lower surface 74*d* of each of the bypass channels 74 is a curved surface which is curved to project (protrude) downward in a case that the lower surface 74*d* is projected in the length direction of the bypass channels 74 (for example, as seen in the cross-section of FIG. 6). Furthermore, since the bypass channels 74 are formed by the half-etching, the lower surface 74*d* of each of the bypass channels 74 has concavities and convexities which are more than those in an upper surface 74*e*, of each of the bypass channels 74, which is formed (defined) by the lower surface of the plate 64. Conversely, the upper surface 74*e* of each of the bypass channels 74 has concavities convexities which are fewer than those in the lower surface 74*d* of each of the bypass channels 74.

As depicted in FIGS. 6, 7, 9A and 9B, supply ports (inflow ports) 75*a* penetrating through the plate 64 are formed in the plate 64 at parts of the plate 64, each of the parts overlapping in the up-down direction with an end part, of one of the upper inflow channels 73*a*, on the side, in the paper width direction, which is opposite to the bypass channel 74. With this configuration, each of the supply ports 75*a* is provided on an upper end surface of one of the upper inflow channels 73*a*. Further, discharge ports (outflow ports) 75*b* penetrating through the plate 64 are formed in the plate 64 at parts of the plate 64, each of the parts overlapping in the up-down direction with an end part, of one of the upper outflow channels 73*b*, on the side, in the paper width direction, which is opposite to the bypass channel 74. With this configuration, each of the discharge ports 75*b* is provided on an upper end surface of one of the upper outflow channels 73*b*.

Note that in the present embodiment, in each of the upper inflow channels 73*a*, the upper outflow channels 73*b* and the bypass channels 74 corresponding to the first and third pressure chamber arrays 39 from the upstream side in the conveyance direction, the left side in the paper width direction corresponds to "one side in the first direction" of the present disclosure, and the right side in the paper width direction corresponds to "the other side in the first direction" of the present disclosure. On the other hand, in each of the upper inflow channels 73*a*, the upper outflow channels 73*b* and the bypass channels 74 corresponding to the second and fourth pressure chamber arrays 39 from the upstream side in the conveyance direction, the right side in the paper width direction corresponds to "one side in the first direction" of the present disclosure, and the left side in the paper width direction corresponds to "the other side in the first direction" of the present disclosure.

Figure 9A:
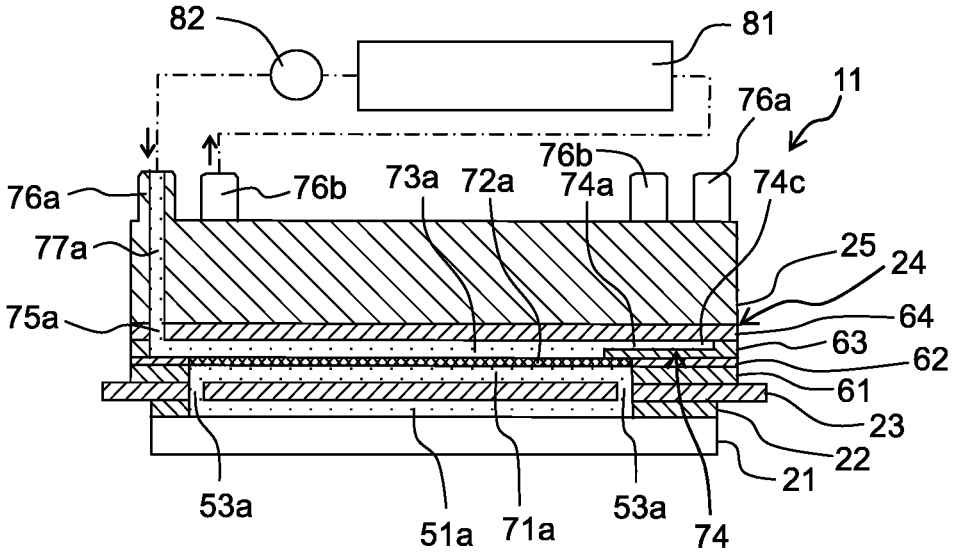
FIG. 9A is a cross-sectional view taken along a line IXA-IXA of FIG. 8.
Figure 9B:
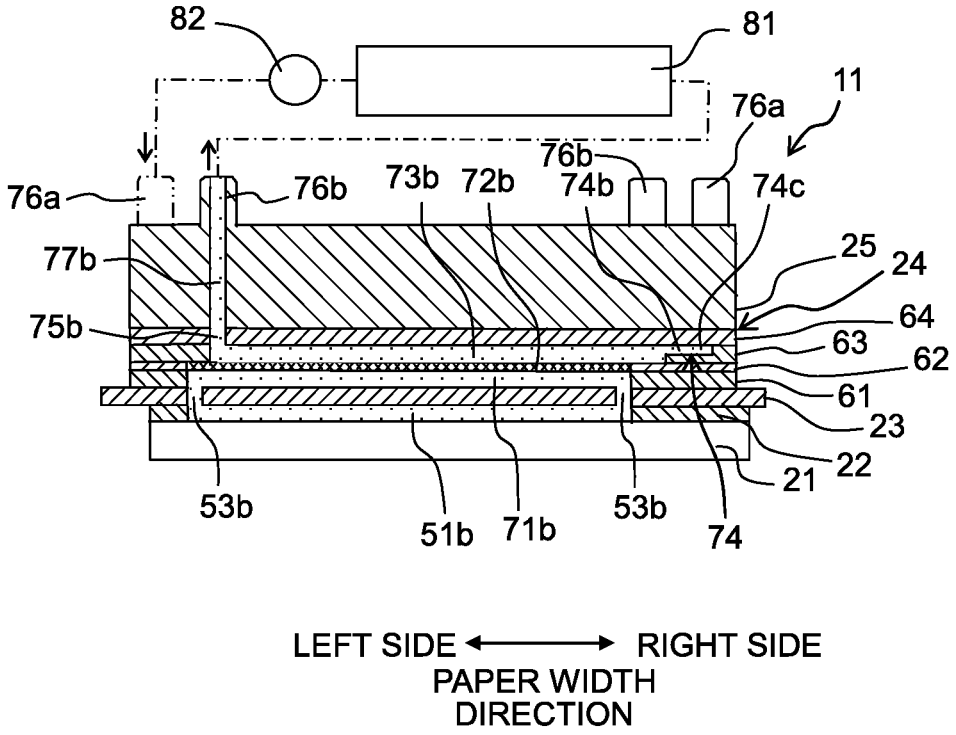
FIG. 9B is a cross-sectional view taken along a line IXB-IXB of FIG. 8.

As depicted in FIGS. 2, 9A and 9B, the joint member 25 is a member having a rectangular parallelepiped-shape and formed of a liquid crystal polymer resin (corresponding to a "third material" of the present disclosure), and is arranged on the upper surface of the plate 64. Protruding parts 76*a* each of which has a cylindrical shape and which projects upward are formed in the upper surface of the joint member 25 at parts thereof overlapping in the up-down direction with the supply ports 75*a*, respectively. Further, protruding parts 76*b* each of which has a cylindrical shape and which projects upward are formed in the upper surface of the joint member 25 at parts thereof overlapping in the up-down direction with the discharge ports 75*b*, respectively.

Further, the joint member 25 is formed with supply channels 77*a* at parts thereof overlapping in the up-down direction with the supply ports 75*a*, respectively. Each of the supply channels 77*a* is connected, at a lower end thereof, as a connection part, with one of the supply ports 75*a*, and extends upward from the connection part; an upper end of each of the supply channels 77*a* is open at the upper end of one of the projected parts 76*a*. Furthermore, the joint member 25 is formed with discharge channels 77*b* at parts thereof overlapping in the up-down direction with the discharge ports 75*b*, respectively. Each of the discharge channels 77*b* is connected, at a lower end thereof, as a connection part, with one of the discharge ports 75*b*, and extends upward from the connection part; an upper end of each of the discharge channels 77*b* is open at the upper end of one of the projected parts 76*b*.

Each of the supply channels 77*a* is connected to a sub tank 81 included in a plurality of sub tanks 81 and storing an ink of which color corresponds to each of the supply channels 77*a*, via a non-depicted tube connected to one of the projected part 76*a* corresponding thereto. Further, a pump 82 which feeds the ink from the sub tank 81 toward each of the supply channels 77*a* is connected between each of the supply channels 77*a* and the sub tank 81. Each of the discharge channels 77*b* is connected to a sub tank 81 storing an ink of which color corresponds to each of the discharge channels 77*b*, via a non-depicted tube connected to one of the projected part 76*b* corresponding thereto. The sub tanks 81 are connected, for example via non-depicted tubes, etc., to non-depicted ink cartridges storing the inks of which colors correspond to the sub tanks 81, respectively; the inks are supplied to the sub tanks 81 from the ink cartridges, respectively.

In a case that the pump 82 is driven in the head unit 11 having the above-described configuration, the ink inside the sub tank 81 is allowed to flow into the upper inflow channel 73*a* via the supply channel 77*a* and the supply port 75*a*. The ink inflowed into the upper inflow channel 73*a* passes through the inflow-side filter 72 and flows into the lower inflow channel 71*a*, and further flows into each of the plurality of individual channels 38 from an upper end of one of the inflow-throttle channels 35*a*, via the inflow hole 53*a* and the inflow manifold 51*a*.

Further, the ink inside each of the plurality of individual channels 38 flows into the lower outflow channel 71*b* from an upper end of one of the outflow-throttle channels 35*b*, via the outflow manifold 51*a* and the discharge hole 53*b*. The ink inflowed into the lower outflow channel 71*b* passes through the outflow-side filter 72*b* and flows into the upper outflow channel 73*b*.

Furthermore, the ink inflowed from the supply port 75*a* into the upper inflow channel 73*a* inflows also into the upper outflow channel 73*b* also via the bypass channel 74, in addition to flowing into the upper outflow channel 73*b* via each of the plurality of individual channels 38, etc., as described above.

Moreover, the ink inflowed into the upper outflow channel 73*b* flows into the sub tank 81 via the discharge port 75*b* and the discharge channel 77*b*, etc.

As described above, in the present embodiment, the ink is circulated between the head unit 11 and the sub tank 81. Further, in the present embodiment, the size, etc., of each of the channels in the inside of the head unit 11 are set such that, in a case that the ink is circulated in such a manner, the total of flow amounts of the ink flowing through the respective individual channels 38 is not less than a flow amount of the liquid flowing through the bypass channel 74.

Further, in the present embodiment, the nozzle plate 32, the pressure chamber substrate 31 and the channel substrate 35 which construct the head chip 21, the manifold plate 22, the inlet plate 23, the plates 61 to 64 constructing the filter unit 24, and the joint member 25 are adhered to one another with a thermo-curable adhesive.

Note that in the present embodiment, a member obtained by combining the pressure chamber substrate 31 and the channel substrate 35 which are formed of Silicon corresponds to a "first channel member" of the present disclosure. Further, a member obtained by combining the manifold plate 22, the inlet plate 23, the plates 61 to 64 constructing the filter unit 24 which are formed of 42 Alloy corresponds to a "second channel member" of the present disclosure.

<Effects>

In the present embodiment, the inflow channel is divided by the inflow-side filter 72*a* into the lower inflow channel 71*a* communicating with the plurality of individual channels 38 and the upper inflow channel 73*a* located above the lower inflow channel 71*a* and formed with the supply ports 75*a*. In a case that any air bubbles in the ink supplied from the supply port 75*a* into the upper inflow channel 73*a* float upward, the air bubbles consequently move in a direction away from the inflow-side filter 72*a*. Accordingly, the air bubbles are less likely to reach the inflow-side filter 72*a*.

Further, in the present embodiment, the outflow channel is divided by the outflow-side filter 72*b* into the lower outflow channel 71*b* communicating with the plurality of individual channels 38 and the upper outflow channel 73*b* located above the lower outflow channel 71*b* and formed with the discharge ports 75*b*. In a case that any air bubbles in the ink in the inside of the upper outflow channel 73*a* float upward, the air bubbles consequently move in a direction away from the outflow-side filter 72*b*. Accordingly, the air bubbles are less likely to reach the outflow-side filter 72*b*.

In view of these configurations, it is possible to prevent the air bubbles from passing through the inflow-side filter 71*a* or the outflow-side filter 72*b* and flowing into the side of the individual channel 38 (the lower inflow channel 71*a*, the lower outflow channel 71*b*). Further, since each of the bypass channels 74 connects the upper inflow channel 73*a* and the upper outflow channel 73*b*, the air bubbles in the ink supplied from the supply port 75*a* into the upper inflow area of 73*a* are allowed to flow to the upper outflow channel 73*b* via the bypass channel 74 and are discharged from the discharge port 75*b*.

In the present embodiment, the upper inflow channel 73*a* and the upper outflow channel 73*b* extend in the paper width direction, and the upper inflow channel 73*a* and the upper outflow channel 73*b* are arranged side by side in the conveyance direction. Furthermore, the bypass channel 74 connects the ends, of the upper inflow channel 73*a* and the upper outflow channel 73*b*, on the same side in the paper width direction. The ink flows in the upper inflow channel 73*a* in the paper width direction toward the bypass channel 74, then the ink flows from the upper inflow channel 73*a* to the upper outflow channel 74 via the bypass channel 74, and then the ink flows in the upper outflow channel 73*b* in the paper width direction such that the ink is separated away from the bypass channel 74. Owing to the flow of the ink as described above, it is possible to cause the air bubbles remaining in the upper inflow channel 73*a* to flow to the upper outflow channel 73*b* via the bypass channel 74 and to discharge the air bubbles from the discharge port 75*b*.

In the present embodiment, the supply port 75*a* is provided on the end part, of the upper inflow channel 73*a*, on the side in the paper width direction which is opposite to the bypass channel 74, and the discharge port 75*b* is provided on the end part, of the upper outflow channel 73*b*, on the side in the paper width direction which is opposite to the bypass channel 74. This configuration easily realizes such a flow of the ink wherein: the ink flows in the upper inflow channel 73*a* from the end, of the upper inflow channel 73*a*, in the paper width direction on the side of the supply port 75*a* toward the other end, of the upper inflow channel 73*a*, on the side of the bypass channel 74; then the ink flows from the upper inflow channel 73*a* to the upper outflow channel 73*b* via the bypass channel 74; and then the ink flows in the upper outflow channel 73*b* from the one end, of the upper outflow channel 73*b*, on the side of the bypass channel 74 toward the other end, of the upper outflow channel 73*b*, on the side of the discharge port 75*b*. With this, it is possible to cause the air bubbles in the ink inflowed from the supply port 75*a* into the upper inflow channel 73*a* to flow into the upper outflow channel 73*b* via the bypass channel 74, and to discharge the air bubbles from the discharge port 75*b* in an assured manner.

In the present embodiment, the bypass channel 74 has the first linear part 74*a* and the second linear part 74*b* which extend in the paper width direction, and the turning part 74*c*. The ink inflowed from the upper inflow channel 73*a* into the bypass channel 74 flows in the first linear part 74*a* in the paper width direction such that the ink is separated away from the upper inflow channel 73*a*, then the ink changes the direction of the flow thereof at the turning part 74*c*, and then the ink flows in the second linear part 74*b* in the paper width direction toward the upper outflow channel 73*b*. With this, it is possible to cause the air bubbles in the inside of the upper inflow channel 73*a* to flow into the upper outflow channel 73*b* via the bypass channel 74.

In the present embodiment, the side wall surfaces 74*c*1 and 74*c*2 of the turning part 74*c* in the bypass channel 74 are the arc-shaped curved surfaces. Furthermore, the side wall surface 74*c*1, the side wall surface 74*a*1 of the first linear part 74*a* and the side wall surface 74*b*1 of the second linear part 74*b* are smoothly continued to one another. Moreover, the side wall surface 74*c*2, the side wall surface 74*a*2 of the first linear part 74*a* and the side wall surface 74*b*2 of the second linear part 74*b* are smoothly continued to one another. With this, the air bubbles are less likely to be caught or trapped in the turning part 74*c*, thereby making it possible to cause the air bubbles in the ink in the inside of the upper inflow channel 73*a* to efficiently flow into the upper outflow channel 73*b* via the bypass channel 74.

Further, in the bypass channel 74 having the first linear part 74*a*, the second linear part 74*b* and the turning part 74*c*, the flow velocity of the ink is greatly lowered at the turning part 74*c* in which the direction of the flow of the ink is changed. In view of this, in the present embodiment, the length L2 in the paper width direction of the second linear part 74*b*, in which the liquid flows after the flow velocity of the liquid is greatly lowered at the turning part 74*c*, is made to be shorter than the length L1 in the paper width direction of the first linear part 74*b* in which the liquid flows before the flow velocity of the liquid is greatly lowered at the turning part 74*c*. With this, it is possible to cause the ink to flow efficiently from the upper inflow channel 73*a* into the upper outflow channel 73*b* via the bypass channel 74.

Furthermore, in the present embodiment, the width of the bypass channel 74 is narrower than the width of each of the upper inflow channel 73*a* and the upper outflow channel 73*b*. On the other hand, the flow velocity of the ink in the upper inflow channel 73*a* and in the upper outflow channel 73*b* which extend in the paper width direction becomes the fastest each at a central part thereof in the conveyance direction. In view of this, in the present embodiment, the bypass channel 74 is connected to each of the upper inflow channel 73*a* and the upper outflow channel 73*b*, at a central part in the conveyance direction, of the end in the paper width direction of each of the upper inflow channel 73*a* and the upper outflow channel 73*b*. Accordingly, the ink is allowed to easily flow from the upper inflow channel 73*a* into the bypass channel 74, and the ink is allowed to easily flow out of the bypass channel 74 into the upper outflow channel 73*b*, thereby making it possible to increase the flow velocity of the ink in the bypass channel 74.

Moreover, in the present embodiment, the cross section, of the bypass channel 74, which is orthogonal to the length direction of the bypass channel 74 is made to be not more than half the cross section, of each of the upper inflow channel 73*a* and the upper outflow channel 73*b*, which is orthogonal to the length direction of each of the upper inflow channel 73*a* and the upper outflow channel 73*b*. This increases the flow velocity of the ink in a case that the ink inflows from the upper inflow channel 73*a* into the bypass channel 74, thereby making is possible to increase the flow velocity of the ink in the bypass channel 74.

Further, in the present embodiment, the side wall surface 73*a*1 at the end part in the paper width direction, of the upper inflow channel 73*a*, located on the side of the bypass channel 74 is such a curved surface which is located further on the inner side of the upper inflow channel 73*a* with respect to the conveyance direction (is inclined with respect to the paper width direction), progressively toward the bypass channel 74 in the paper width direction. The air bubbles in the inside of the upper inflow channel 73*a* easily flows into the bypass channel 74 along the side wall surface 73*a*1, which in turn cause the air bubbles to less likely to remain at the boundary part between the upper inflow channel 73*a* and the bypass channel 74.

In the present embodiment, the supply port 75*a* is provided in the upper end surface of the upper inflow channel 73*a*. Accordingly, in a case that the ink inflows from the supply port 75*a* into the upper inflow channel 73*a*, the air bubbles in the ink is less likely to flow into the upper inflow channel 73*a*.

Furthermore, in the present embodiment, the supply channel 77*a* extends upward from the connection part thereof with respect to the supply port 75*a*. Accordingly, the air bubbles in the ink inside the supply channel 77*a* is less likely to reach the supply port 75*a*.

In the present embodiment, the discharge port 75*b* is provided in the upper end surface of the upper outflow channel 73*b*. Accordingly, the air bubbles discharged from the discharge port 75*a* to the outside of the upper outflow channel 73*b* is less likely to return to the upper outflow channel 73*b*.

Further, in the present embodiment, the discharge channel 77*b* extends upward from the connection part thereof with respect to the discharge port 75*b*. Accordingly, the air bubbles in the ink inside the discharge channel 77*b* is less likely to return to the discharge port 75*b*.

In the present embodiment, since the air bubbles are likely to remain or be trapped at the upper end part of each of the upper inflow channel 73*a* and the upper outflow channel 73*b*, the upper end part of the upper inflow channel 73*a* and the upper end part of the upper outflow channel 73*b* are connected to each other by the bypass channel 74. With this, it is possible to cause the air bubbles to flow efficiently from the upper inflow channel 73*a* to the upper outflow channel 73*b*, via the bypass channel 74.

Figure 7A:
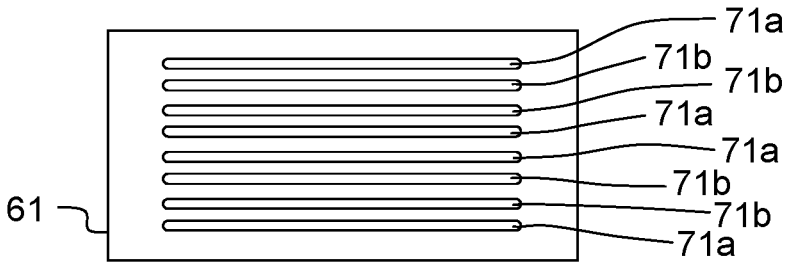
FIGS. 7A to 7D are plan view of four plates, respectively.
Figure 7B:
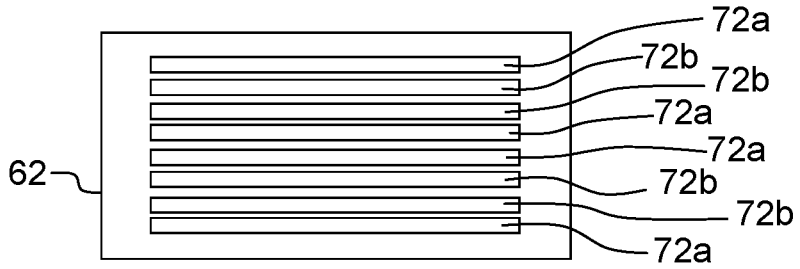
Figure 7C:
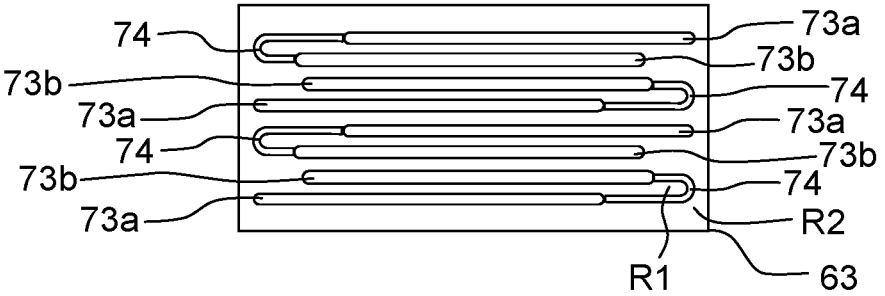
Figure 7D:
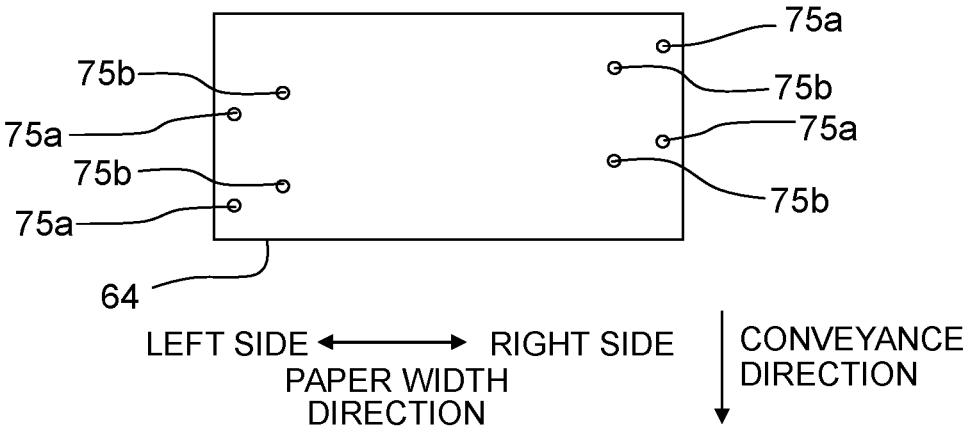
Figure 8:
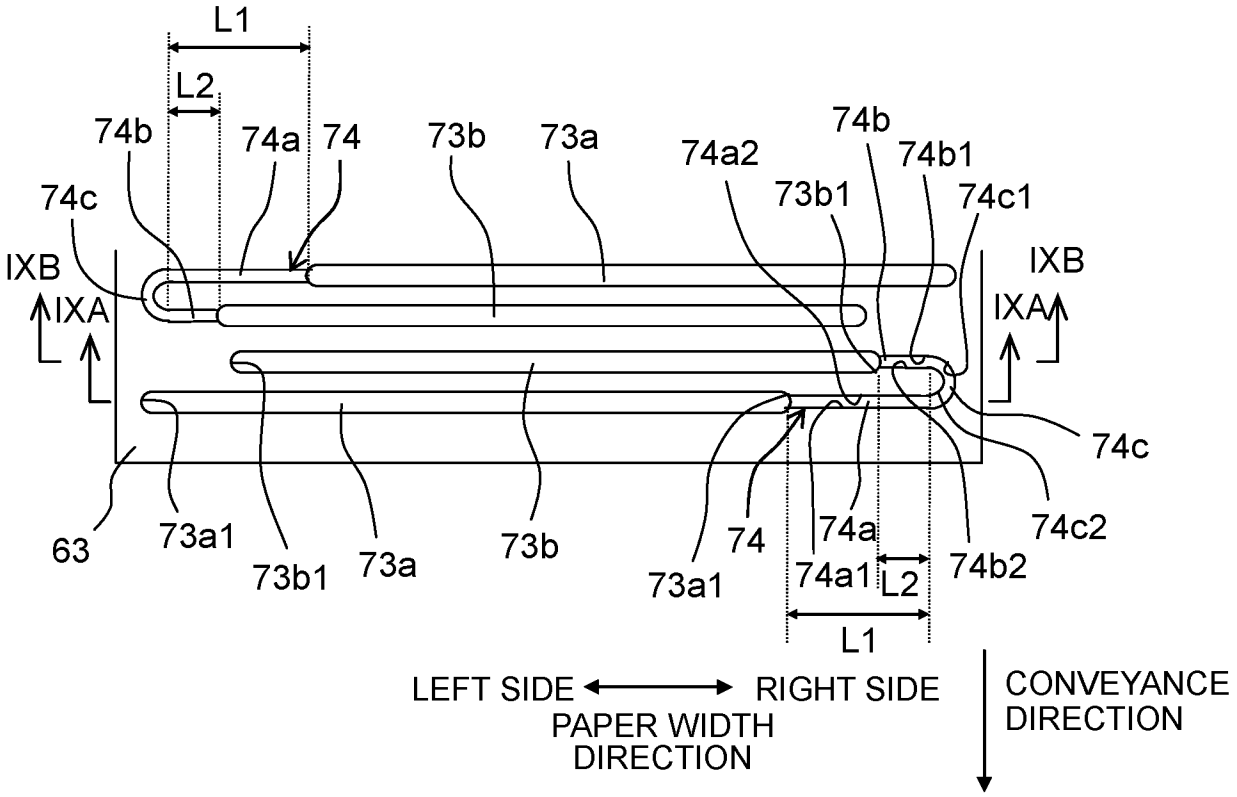
FIG. 8 is an enlarged view of a part of a plate which is included in the four plates and which is depicted in FIG. 7C.

Moreover, in the present embodiment, in the plate 63 formed with the upper inflow channels 73*a*, the upper outflow channels 73*b* and the bypass channels 74, parts each of which is surrounded by one of the upper inflow channels 73*a*, one of the upper outflow channels 73*b* and one of the bypass channels 74 (for example, a part indicated with a reference numeral "R1" in FIG. 7C) is present in the plate 63. On the other hand, in the present embodiment, the upper inflow channels 73*a* and the upper outflow channels 73*b* penetrate through the plate 63, whereas the bypass channels 74 are formed in the upper part of the plate 63. Accordingly, in the plate 63, the part surrounded by the upper inflow channel 73, the upper outflow channel 73*b* and the bypass channel 74, and a part outside these channels (for example, a part indicated with a reference numeral "R2" in FIG. 7C) are connected (continued or linked) to each other by a part in the plate 62 located below the bypass channel 74. Owing this configuration, the part, in the plate 63, which is surrounded by the upper inflow channel 73, the upper outflow channel 73*b* and the bypass channel 74 is stabilized. Further, the bypass channels 74 which are located at the upper part of the plate 63 can be easily formed by the half-etching.

Further, in the present embodiment, the lower surface 74*a* of each of the bypass channels 74 is a curved surface which is curved to project downward in a case that the lower surface 74*d* is projected in the length direction of the bypass channel 74. Accordingly, it is possible to make the air bubbles to be less likely to accumulate or remain in a boundary part between the lower surface 74*d* and the side surface of the bypass channel 74. Furthermore, by forming the bypass channels 74 by performing the half-etching for the plate 63, it is possible to easily form the bypass channels 74 in which the lower surface 74*d* of each of the bypass channels 74 is the above-described curved surface.

Moreover, in the present embodiment, since the air bubbles are likely to accumulate in the upper end part of the bypass channel 74, the upper surface 74*e* of the bypass channel 74 which is formed by the lower surface of the plate 64 has concavities and convexities which are fewer than those in the lower surface 74*d* of the bypass channel 74. With this, it is possible to make the air bubble to be less likely to accumulate or remain in the upper end part of the bypass channel 74.

Further, in the present embodiment, the size, etc., of each of the channels in the inside of the head unit 11 are set such that, in a case that the ink is circulated between the head unit 11 and the sub tank 81, the total of the flow amounts of the ink flowing through the plurality of individual channels 38 is not less than the flow amount of the ink flowing through the bypass channel 74. With this, it is possible to prevent the flow amount of the ink from the upper inflow channel 73*a* to the upper outflow channel 73*b* via the bypass channel 74 from becoming too great and consequently to prevent any short supply of the ink to the plurality of individual channels 38.

Furthermore, in the present embodiment, the head chip 21, the manifold plate 22, the inlet plate 23, the filter unit 24, and the joint member 25 are adhered to one another with the thermo-curable adhesive. Here, the pressure chamber substrate 31 and the channel substrate 35 of the head chip 21 are each formed of silicon (Si). Moreover, the manifold plate 22, the inlet plate 23 and the plates 61 to 64 of the filter unit 24 are each formed of 42 Alloy. Further, the joint member 25 is formed of the liquid crystal polymer resin. The linear expansion coefficient of 42 Alloy ($4.2\times10^{-6}$ [m/° C.]) is intermediate of the linear expansion coefficient of the silicon ($3.0\times10^{-6}$ [m/° C.]) and the linear expansion coefficient of the liquid crystal polymer resin ($10.0\times10^{-6}$ [m/° C.]). With this, it is possible to prevent any warpage or curvature from occurring in these members in a case that the members are adhered to one another with the thermo-curable adhesive.

Although the embodiment of the present disclosure has been explained in the foregoing, the present disclosure is not limited to or restricted by the above-described embodiment; it is allowable to make a various kind of changes to the present embodiment in the present disclosure, within the scope described in the claims.

For example, it is allowable to use different materials, for the members of the head unit, which are different from those in the above-described embodiment. In a case that a first material is used for the pressure chamber substrate 31 and the channel substrate 35 of the head chip 21, that a second material is used for the plates 61 to 64 of the filter unit 24, and that a third material is used for the joint member 25, and that the linear expansion coefficient of the second material is intermediate of the linear expansion coefficient of the first material and the linear expansion coefficient of the third material, any warpage or curvature is less likely to occur when these members are adhered to one another with the thermo-curable adhesive, similarly to the above-described embodiment.

For example, it is allowable to use SUS304 (linear expansion coefficient: $17.3\times10^{-6}$ [m/° C.]) or SUS430 (linear expansion coefficient: $10.4\times10^{-6}$ [m/° C.]), etc., for the manifold plate 22, the inlet plate 23 and the plates 61 to 64 of the filter unit 24, and to use 42 Alloy, alumina ($Al_2O_3$, linear expansion coefficient: $7.2\times10^{-6}$ [m/° C.]), an epoxy resin (linear expansion coefficient: $9.0\times10^{-6}$ [m/° C.]), etc., for the joint member 25. In a case that the alumina is used for the joint member 25, it is possible to form the joint member 25 as a stacked body constructed of a plurality of plates made of alumina, which in turn makes it possible to form slender or narrow channels easily. In a case that the epoxy resin is used for the joint member 25, it is possible to mass-produce the joint member 25 by means of molding, whereas it is hard to form slender or narrow channels.

Further, it is allowable that the magnitude relationship among the linear expansion coefficients of the first to third materials may be different from the magnitude relationship as described above.

Furthermore, in the above-described embodiment, although the upper surface of the bypass channel 74 (the lower surface of the plate 64) has the concavities and convexities which are fewer than those in the lower surface of the bypass channel 74, the present disclosure is not limited to this. For example, it is allowable that the upper plate and the lower plate of the bypass channel 74 have the concavities and convexities formed therein to a mutually same extent.

Moreover, in the above-described embodiment, in a case that the ink circulates between the head unit 11 and the sub tank 81, the total of flow amounts of the ink flowing through the plurality of individual channels 38 is not less than the flow amount of the liquid flowing through the bypass channel 74. However, the present disclosure is not limited to this. In the case that the ink circulates between the head unit 11 and the sub tank 81, it is allowable that the total of flow amounts of the liquid flowing through the plurality of individual channels 38 is smaller than the flow amount of the liquid flowing through the bypass channel 74.

Further, in the above-described embodiment, the width and the depth of the bypass channel 74 are constant and the cross section, of the bypass channel 74, in the direction orthogonal to the direction of the flow of the ink is constant. However, the present disclosure is not limited to this.

Figure 10:
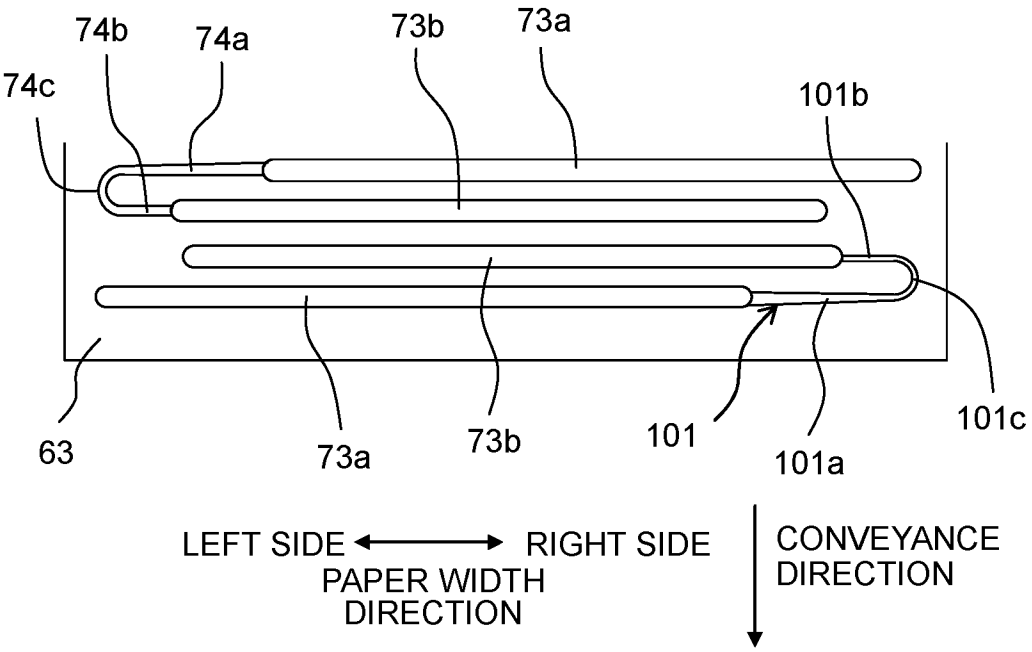
FIG. 10 is a view of Modification 1, corresponding to FIG. 8.

For example, in Modification 1, an upper inflow channel 73*a* and an upper outflow channel 73*b* are connected to each other via a bypass channel 101, as depicted in FIG. 10. The bypass channel 101 has a first linear part 101*a*, a second linear part 102 and a turning part 101*c*, similarly to the bypass channel 74. However, in the bypass channel 101, the width of the bypass channel 101 is gradually narrowed (the cross section of the bypass channel 101 orthogonal to the length direction is made to be gradually small) from a connection part of the bypass channel 101 with respect to the upper inflow channel 73*a* toward a connection part of the bypass channel 101 with respect to the upper outflow channel 73*b*.

In Modification 1, since the cross section, of the bypass channel 101, which is orthogonal to the length direction is made to be gradually smaller from the connection part of the bypass channel 101 with respect to the upper inflow channel 73*a* toward the connection part of the bypass channel 101 with respect to the upper outflow channel 73*b*, the flow velocity of the ink in the bypass channel 101 becomes faster progressively from the connection part of the bypass channel 101 with respect to the upper inflow channel 73*a* toward the connection part of the bypass channel 101 with respect to the upper outflow channel 73*b*. With this, in the bypass channel 101, the ink flows easily from the connection part of the bypass channel 101 with respect to the upper inflow channel 73*a* toward the connection part of the bypass channel 101 with respect to the upper outflow channel 73*b*.

Further, in Modification 1, the width is made to be narrower progressively from the connection part of the bypass channel 101 with respect to the upper inflow channel 73*a* toward the connection part of the bypass channel 101 with respect to the upper outflow channel 73*b*, the present disclosure is not limited to this. It is allowable that the depth of the bypass channel is made shallower progressively from the connection part of the bypass channel with respect to the upper inflow channel 73*a* toward the connection part of the bypass channel with respect to the upper outflow channel 73*b*. Alternatively, it is allowable that the width of the bypass channel is made to be narrower and the depth of the bypass channel is made shallower progressively from the connection part of the bypass channel with respect to the upper inflow channel 73*a* toward the connection part of the bypass channel with respect to the upper outflow channel 73*b*. In these cases also, the cross section, of the bypass channel, which is orthogonal to the length direction of the bypass channel is made to be gradually smaller from the connection part of the bypass channel with respect to the upper inflow channel 73*a* toward the connection part of the bypass channel with respect to the upper outflow channel 73*b*.

Furthermore, in the above-described embodiment, the lower surface of each of the bypass channels 74 is the curved surface which is curved to project downward as being projected in the length direction of the bypass channels 74, and which is smoothly continued to the side wall surface of the bypass channel 74. However, the present disclosure is not limited to this. For example, it is allowable that each of the lower surface and the side wall surface of the bypass channel is a flat surface, and that a corner part is present at the boundary part between the lower surface and the side wall surface of the bypass channel.

Moreover, in the above-described embodiment, one plate that is the plate 63 is formed with the upper inflow channels 73*a* and the upper outflow channels 73*b* which penetrate through the plate 63, and the bypass channels 74 which is located in the upper part of the plate 63. With this, the upper end parts of the upper inflow channels 73*a* and the upper end parts of the upper outflow channels 73*b* are connected by the bypass channels 74, respectively. However, the present disclosure is not limited to this.

For example, it is allowable that two plates which are stacked on top of each other are arranged, instead of providing the plate 63, and that the upper inflow channels and the upper outflow channels are formed so as to penetrate through the two plates, and that the bypass channels are formed so as to penetrate only an upper plate among the two plates.

Further, it is allowable that each of the bypass channels is not connected to the upper end part of one of the upper inflow channels and to the upper end part of one of the upper outflow channels. For example, it is allowable that each of the bypass channels is connected to a part or portion, of one of the upper inflow channels, which is different from the upper end part. Further, it is allowable that each of the bypass channels is connected to a part or portion, of one of the upper outflow channels, which is different from the upper end part.

Furthermore, in the above-described embodiment, although each of the supply channels 77*a* extends upward from the connection part with respect to one of the supply ports 75*a*, the present disclosure is not limited to this. For example, it is allowable that each of the supply channels 77*a* extends in a horizontal direction from the connection part with respect to one of the supply ports 75*a*.

Moreover, in the above-described embodiment, although each of the discharge channels 77*b* extends upward from the connection part with respect to one of the discharge ports 75*b*, the present disclosure is not limited to this. For example, it is allowable that each of the discharge channels 77*b* extends in a horizontal direction from the connection part with respect to one of the discharge ports 75*b*.

Further, in the above-described embodiment, although the supply ports 75*a* are formed in the plate 64 defining the upper end surfaces of the upper inflow channels 73*a*, the present disclosure is not limited to this. For example, it is allowable that the supply ports 75*a* are formed in the plate 63 and that each of the supply ports 75*a* is open at a side wall surface of one of the upper inflow channel 73*a*.

Furthermore, in the above-described embodiment, although the discharge ports 75*b* are formed in the plate 64 defining the upper end surfaces of the upper outflow channels 73*b*, the present disclosure is not limited to this. For example, it is allowable that the discharge ports 75*b* are formed in the plate 63 and that each of the discharge ports 75*b* is open at a side wall surface of one of the upper outflow channel 73*b*.

Figure 11:
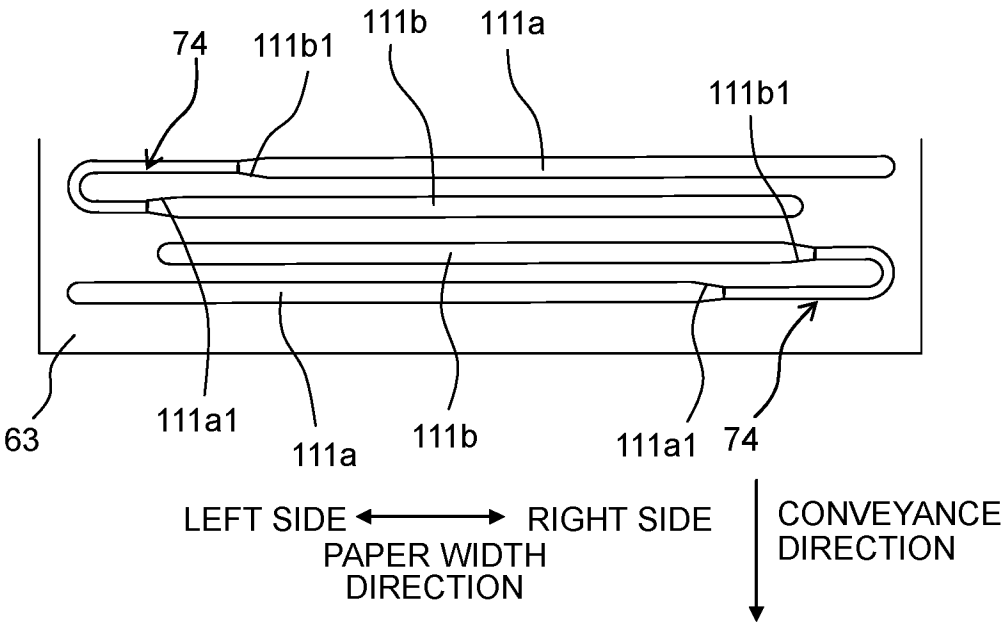
FIG. 11 is a view of Modification 2, corresponding to FIG. 8.

Further, the side wall surface, of each of the upper inflow channels 73*a* and the upper outflow channels 73*a* which is located on the end part thereof in the paper width direction on the side of the bypass channel 74, is not limited to being arc-shaped curved surface. For example, in Modification 2 as indicated in FIG. 11, an upper inflow channel 111*a* is formed with, at an end part thereof in the paper width direction on the side of the bypass channel 74, a side wall surface 111*a*1 which is a flat surface inclined with respect to the paper width direction such that the side wall surface 111*a*1 is located further on the central side with respect to the conveyance direction, progressively toward the bypass channel 74 in the paper width direction. Further, an upper outflow channel 111*b* is formed with, at an end part thereof in the paper width direction on the side of the bypass channel 74, a side wall surface 111*b*1 which is flat surface inclined with respect to the paper width direction such that the side wall surface 111*b*1 is located further on the central side with respect to the conveyance direction, progressively toward the bypass channel 74 in the paper width direction.

Also in this case, since the ink inside the upper inflow channel 111*a* easily flows into the bypass channel 74 along the side wall surface 111*a*1, it is possible to prevent any air bubbles in the ink from accumulating in the end part, in the paper width direction of the upper inflow channel 111*a*, which is located on the side of the bypass channel 74. Further, since there is no corner part provided on the end part, in the paper width direction of the upper outflow channel 111*b*, which is located on the side of the bypass channel 74, the air bubbles are less likely to accumulate in the end part, in the paper width direction of the upper outflow channel 111*b*, which is located on the side of the bypass channel 74.

Furthermore, it is allowable that the side wall surface, of each of the upper inflow channel and the upper outflow channel, which is connected to the side wall surface of the bypass channel 74 is not the inclined surface inclined with respect to the paper width direction. For example, the side wall surface, of each of the upper inflow channel and the upper outflow channel, may extend parallel to the paper width direction up to an end part thereof, in the paper width direction, which is located on the side of the bypass channel 74; then the side wall surface may be bent by 90 degrees to the central side in the conveyance direction and may be connected to the side wall surface of the bypass channel 74.

Moreover, the cross section, of the bypass channel 74, which is orthogonal to the length direction of the bypass channel 74 and of the cross sections, of the upper inflow channels 73*a* and the upper outflow channel 73*b*, which are orthogonal to the length direction of the upper inflow channels 73*a* and the upper outflow channel 73*b* are not limited to those in the above-described embodiment. Even in a case that these cross-sectional areas are different from those in the above-described embodiment, provided that the cross section of the bypass channel 74 is not more than half the cross section of each of the upper inflow channel 73*a* and the upper outflow channel 73*b*, it is possible to increase the flow velocity of the ink in the bypass channel.

Further, it is allowable that the cross section of the bypass channel 74 is greater than half the above-described cross section of each of the upper inflow channel 73*a* and the upper outflow channel 73*b*, and is smaller than the above-described cross section of each of the upper inflow channel 73*a* and the upper outflow channel 73*b*. In this case also, it is possible to increase the flow velocity of the ink in the bypass channel to some extent.

Furthermore, in the above-described embodiment, the width of the bypass channel 74 is made to be narrower than the width of the upper inflow channel 73*a* and the width of the upper outflow channel 73*b* and the depth of the bypass channel 74 is made to be shallower than the depth of the upper inflow channel 73*a* and the depth of the upper outflow channel 73*b*, thereby making the cross section of the bypass channel 74 to be smaller than the above-described cross section of each of the upper inflow channel 73*a* and the upper outflow channel 73*b*. However, the present disclosure is not limited to this.

For example, it is allowable that the width of the bypass channel 74 is made to be narrower than the width of the upper inflow channel 73*a* and the width of the upper outflow channel 73*b* and that the depth of the bypass channel 74 is made to be substantially same as the depth of the upper inflow channel 73*a* and the depth of the upper outflow channel 73*b*. Alternatively, it is allowable that the depth of the bypass channel 74 is made to be shallower than the depth of the upper inflow channel 73*a* and that the depth of the upper outflow channel 73*b* and the width of the bypass channel 74 is made to be substantially same as the width of the upper inflow channel 73*a* and the width of the upper outflow channel 73*b*.

Further, the above-described cross section of the bypass channel 74 is not limited to being smaller than the above-described cross section of each of the upper inflow channel 73*a* and the upper outflow channel 73*b*. The above-described cross section of the bypass channel 74 may be substantially same as the above-described cross section of each of the upper inflow channel 73*a* and the upper outflow channel 73*b*.

Further, in the above-described embodiment, the bypass channel 74 is connected to each of the upper inflow channel 73*a* and the upper outflow channel 73*b*, at the central part in the conveyance direction, of the end (end part) in the paper width direction of each of the upper inflow channel 73*a* and the upper outflow channel 73*b*. However, the present disclosure is not limited to this. For example, the bypass channel 74 may be connected to each of the upper inflow channel 73*a* and the upper outflow channel 73*b*, at an upstream part in the conveyance direction relative to the central part in the conveyance direction, of the end (end part) in the paper width direction of each of the upper inflow channel 73*a* and the upper outflow channel 73*b*, or at a downstream part in the conveyance direction relative to the central part in the conveyance direction, of the end (end part) in the paper width direction of each of the upper inflow channel 73*a* and the upper outflow channel 73*b*.

Furthermore, in the above-described embodiment, the upper inflow channel 73*a* and the upper outflow channels 73*b* are arranged to shift from each other in the paper width direction; and in the bypass channel 74, the length L2 in the paper width direction of the second linear part 74*b* is made to be shorter than the length L1 in the paper width direction of the first linear part 74*a*. However, the present disclosure is not limited to this.

For example, it is allowable that the upper inflow channel 73*a* and the upper outflow channels 73*b* are arranged to shift from each other in the paper width direction but in a direction of the shift which is opposite to that in the above-described embodiment; and that in the bypass channel 74, the length in the paper width direction of the first linear part is made to be shorter than the length in the paper width direction of the second linear part. Alternatively, it is allowable that the upper inflow channel 73*a* and the upper outflow channels 73*b* are arranged at substantially same positions, respectively, in the paper width direction; and that in the bypass channel 74, the length in the paper width direction of the first linear part is made to be substantially same as the length in the paper width direction of the second linear part.

Moreover, in the above-described embodiment, the side wall surface 74*c*1 of the turning part 74*c* in the bypass channel 74 is the arc-shaped curved surface smoothly continued to the side wall surface 74*a*1 of the first linear part 74*a* and the side wall surface 74*b*1 of the second linear part 74*b*, and the side wall surface 74*c*2 of the turning part 74*c* is the curved surface smoothly continued to the side wall surface 74*a*2 of the first linear part 74*a* and the side wall surface 74*b*2 of the second linear part 74*b*. However, the present disclosure is not limited to this. For example, it is allowable that the turning part extends linearly along the conveyance direction, and that the side wall surface of the turning part is a flat surface which is parallel to the conveyance direction.

Further, in the above-described embodiment, although the bypass channel 74 has the first linear part 74*a*, the second linear part 74*b* and the turning part 74*c*, the present disclosure is not limited to this. For example, it is allowable that the bypass channel extends in the conveyance direction at a position between the upper inflow channel 73*a* and the upper outflow channel 73*b* in the conveyance direction, and connects the upper inflow channel 73*a* and the upper outflow channel 73*b* with each other.

Furthermore, in the above-described embodiment, although each of the supply ports 75*a* is provided on the end part, of one of the upper inflow channels 73*a*, on the opposite side in the paper width direction to the bypass channel 74, the present disclosure is not limited to this. It is allowable, for example, that each of the supply ports is provided on a central part in the paper width direction of one of the upper inflow channels 73*a*.

Moreover, in the above-described embodiment, although each of the discharge ports 75*b* is provided on the end part, of one of the upper outflow channels 73*b*, on the opposite side in the paper width direction to the bypass channel 74, the present disclosure is not limited to this. It is allowable, for example, that each of the discharge ports is provided on a central part in the paper width direction of one of the upper outflow channels 73*b*.

Moreover, in the above-described embodiment, both of the upper inflow channel 73*a* and the upper outflow channel 73*b* extend in the paper width direction, and the bypass channel 74 connects the ends, of the upper inflow channel 73*a* and the upper outflow channel 73*b*, respectively, which are on a same side in the paper width direction. However, the present disclosure is not limited to this. It is allowable that the bypass channel is connected to another part, of the upper inflow channel, which is different from the above-described part (end), or to another part, of the upper outflow channel, which is different from the above-described part (end). Further, it is allowable that the upper inflow channel and the upper outflow channel do not extend parallel to each other.

Further, in the foregoing, although the explanation has been given about the case in which the present disclosure is applied to the head unit constructing a so-called line head, the applicability of the present disclosure is not limited to this. For example, the present disclosure is applicable also to a so-called serial head which is mounted on a carriage and is movable together with the carriage. Further, the present disclosure is also applicable to a liquid discharging head which discharges a liquid different from the ink, such as a liquefied metal, resin, etc.

What is claimed is:

1. A liquid discharging head, comprising:

individual channels each of which includes a nozzle;

an inflow channel which is communicated with the individual channels and via which liquid flows into the individual channels;

an outflow channel which is communicated with the individual channels and via which the liquid flows out from the individual channels;

an inflow-side filter which is provided on the inflow channel and which divides the inflow channel into a lower inflow area communicated with the individual channels and an upper inflow area located above the lower inflow area;

an outflow-side filter which is provided on the outflow channel and which divides the outflow channel into a lower outflow area communicated with the individual channels and an upper outflow area located above the lower outflow area;

an inflow port which is provided on the upper inflow area at a first end of the inflow channel and through which the liquid is supplied to the inflow channel from outside thereof;

an outflow port which is provided on the upper outflow area at a first end of the outflow channel and through which the liquid is discharged from the outflow channel to outside thereof; and a bypass channel which connects the upper inflow area and the upper outflow area at second ends of the inflow channel and outflow channel, respectively, that are opposite the first end of the inflow channel and the first end of the outflow channel, respectively.

2. The liquid discharging head according to claim 1, wherein the inflow channel and the outflow channel extend along a first direction which is horizontal, the inflow channel and the outflow channel are arranged side by side in a second direction which is horizontal and is orthogonal to the first direction, and the bypass channel connects an end part on one side in the first direction of the upper inflow area and an end part on the one side in the first direction of the upper outflow area.

3. The liquid discharging head according to claim 2, wherein the inflow port is provided on an end part on the other side in the first direction of the upper inflow area, and the outflow port is provided on an end part on the other side in the first direction of the upper outflow area.

4. The liquid discharging head according to claim 2, wherein the bypass channel has:

a first linear part connected to the upper inflow area and extending along the first direction;

a second linear part connected to the upper outflow area and extending along the first direction; and a turning part connecting an end on the one side in the first direction of the first linear part and an end on the one side in the first direction of the second linear part.

5. The liquid discharging head according to claim 4, wherein a side wall surface of the turning part is a curved surface which is smoothly continued to a side wall surface of the first linear part and a side wall surface of the second linear part.

6. The liquid discharging head according to claim 4, wherein the end part on the one side in the first direction of the upper inflow area is located on the other side in the first direction with respect to the end part on the one side in the first direction of the upper outflow area, and length in the first direction of the second linear part is shorter than length in the first direction of the first linear part.

7. The liquid discharging head according to claim 2, wherein the bypass channel connects a central portion in the second direction of the end part on the one side in the first direction of the upper inflow area with a central portion in the second direction of the end part on the one side in the first direction of the upper outflow area.

8. The liquid discharging head according to claim 2, wherein a cross section, of the bypass channel, which is orthogonal to a length direction the bypass channel is smaller than a cross section, of each of the upper inflow area and the upper outflow area, which is orthogonal to the first direction.

9. The liquid discharging head according to claim 8, wherein the cross section, of the bypass channel, which is orthogonal to the length direction of the bypass channel is equal to or less than half the cross section, of each of the upper inflow area and the upper outflow area, which is orthogonal to the first direction.

10. The liquid discharging head according to claim 8, wherein the cross section, of the bypass channel, which is orthogonal to the length direction of the bypass channel is in a range of equal to more than 0.1 $mm^2$ and equal to or less than 0.5 $mm^2$ and the cross section, of each of the upper inflow area and the upper outflow area, which is orthogonal to the first direction is in a range of not less than 0.3 $mm^2$ and not more than 1.0 $mm^2$.

11. The liquid discharging head according to claim 8, wherein a connection part, of the bypass channel, at which the bypass channel is connected to the upper inflow area has a length in the second direction shorter than that of the upper inflow area, and a side wall surface in the second direction of the end part on the one side in the first direction of the upper inflow area is inclined with respect to the first direction such that the side wall surface is located further on an inner side with respect to the second direction, progressively from the other side toward the one side in the first direction.

12. The liquid discharging head according to claim 1, wherein the inflow port is provided on an upper end surface of the upper inflow area.

13. The liquid discharging head according to claim 12, further comprising a supply channel which is connected to the inflow port and which extends upwardly from a connection part of the supply channel at which the supply channel is connected to the inflow port.

14. The liquid discharging head according to claim 1, wherein the outflow port is provided on an upper end surface of the upper outflow area.

15. The liquid discharging head according to claim 13, further comprising a discharge channel which is connected to the outflow port and which extends upwardly from a connection part of the discharge channel at which the discharge channel is connected to the outflow port.

16. The liquid discharging head according to claim 1, wherein the bypass channel connects an upper end part of the upper inflow area and an upper end part of the upper outflow area.

17. The liquid discharging head according to claim 16, further comprising a plate-shaped member in which the upper inflow area, the upper outflow area and the bypass channel are formed, wherein the upper inflow area and the upper outflow area penetrate through the plate-shaped member, and the bypass channel is formed in an upper part of the plate-shaped member.

18. The liquid discharging head according to claim 17, wherein in a case that a lower surface of the bypass channel is projected in a direction orthogonal to a length direction of the bypass channel, the lower surface of the bypass channel is a curved surface which is curved to project downward.

19. The liquid discharging head according to claim 1, wherein the bypass channel has a cross section which is orthogonal to a length direction of the bypass channel and which is progressively smaller in a direction from a connection part of the bypass channel at which the bypass channel is connected to the upper inflow area toward a connection part of the bypass channel at which the bypass channel is connected to the upper outflow area.

20. The liquid discharging head according to claim 1, wherein total of flow amounts of the liquid flowing through the individual channels is equal to or more than a flow amount of the liquid flowing through the bypass channel.

21. The liquid discharging head according to claim 1, wherein an upper surface of the bypass channel has concavities and convexities which are fewer than those in a lower surface of the bypass channel.

22. The liquid discharging head according to claim 1, further comprising:

a first channel member which is formed of a first material and in which at least a part of the individual channels is formed;

a second channel member which is formed of a second material, in which the inflow channel, the outflow channel and the bypass channel are formed, and which is joined to the first channel member; and a joint member which is formed of a third material, in which a supply channel connected to the support port and a discharge channel connected to the outflow port are formed, and which is joined to the second channel member, wherein the first channel member, the second channel member and the joint member are joined to one another with a thermo-curable adhesive; and linear expansion coefficient of the second material is intermediate of linear expansion coefficient of the first material and linear expansion coefficient of the third material.

* * * * *